US012736262B2

(12) United States Patent
Wiesmann et al.

(10) Patent No.: US 12,736,262 B2
(45) Date of Patent: Sep. 15, 2026

(54) SYSTEMS, CONTROLLERS, AND METHODS FOR CONTROLLING A CO2 REFRIGERATION SYSTEM

(71) Applicant: Copeland LP, Sidney, OH (US)

(72) Inventors: Donald R. Wiesmann, Troy, OH (US); Diane B. Patrizio, Sidney, OH (US)

(73) Assignee: Copeland LP, Sidney, OH (US)

( * ) Notice: Subject to any disclaimer, the term of this patent is extended or adjusted under 35 U.S.C. 154(b) by 131 days.

(21) Appl. No.: 19/003,786

(22) Filed: Dec. 27, 2024

(65) Prior Publication Data

US 2026/0118029 A1 Apr. 30, 2026

Related U.S. Application Data

(60) Provisional application No. 63/615,936, filed on Dec. 29, 2023.

(51) Int. Cl.
*F25B 49/02* (2006.01)
*F25B 9/00* (2006.01)

(52) U.S. Cl.
CPC ..... *F25B 49/022* (2013.01); *F25B 9/008* (2013.01); *F25B 2309/061* (2013.01); *F25B 2400/0409* (2013.01); *F25B 2400/0411* (2013.01); *F25B 2400/16* (2013.01); *F25B 2600/17* (2013.01); *F25B 2700/195* (2013.01)

(58) Field of Classification Search
CPC .... F25B 9/008; F25B 49/02; F25B 2309/061; F25B 2600/17
See application file for complete search history.

(56) References Cited

U.S. PATENT DOCUMENTS

| | | | | |
|---|---|---|---|---|
| 9,625,183 | B2 * | 4/2017 | Wallace | F25B 9/008 |
| 2010/0175400 | A1 * | 7/2010 | Kasahara | F25B 49/02 62/426 |
| 2014/0151015 | A1 * | 6/2014 | Sun | F25B 49/02 62/190 |
| 2021/0348813 | A1 | 11/2021 | Winandy et al. | |
| 2023/0077084 | A1 * | 3/2023 | Shanmugam | F25B 49/02 |

FOREIGN PATENT DOCUMENTS

| | | | |
|---|---|---|---|
| CN | 109489287 | A | 3/2019 |
| EP | 2212631 | B1 | 12/2016 |
| GB | 2581720 | A | 8/2020 |
| JP | 5927553 | B2 | 6/2016 |
| JP | 2019128050 | A | 8/2019 |

OTHER PUBLICATIONS

PCT International Search Report and Written Opinion, Application No. PCT/US2024/062102, dated Apr. 24, 2025, 15 pages.
PCT International Search Report and Written Opinion, Application No. PCT/US2024/062109, dated Apr. 29, 2025, 28 pages.

* cited by examiner

*Primary Examiner* — Jonathan Bradford
(74) *Attorney, Agent, or Firm* — Armstrong Teasdale LLP

(57) ABSTRACT

A method of controlling a $CO_2$ refrigeration system includes obtaining a target exit pressure of refrigerant from a gas cooler/condenser, a measurement of a pressure of the flash tank, and an open percentage of a bypass valve (BGV). Whether or not to decrease the pressure of the flash tank is determined, based at least in part on the pressure of the flash tank and the open percentage of the BGV. When the controller determines to decrease the pressure of the flash tank, the target exit pressure is increased by an amount.

20 Claims, 12 Drawing Sheets

SYSTEMS, CONTROLLERS, AND METHODS FOR CONTROLLING A CO2 REFRIGERATION SYSTEM

CROSS REFERENCE TO RELATED APPLICATIONS

This application claims priority to U.S. Provisional Patent Application No. 63/615,936, filed on Dec. 29, 2023, which is hereby incorporated by reference in its entirety.

BACKGROUND

This application relates generally to controlling refrigeration systems. More specifically, this application relates to systems, controllers, and methods for controlling a CO2 refrigeration system.

Known CO2 refrigeration systems typically use a two-mode control structure to change the control mode depending on whether the system is operating in subcritical operation mode or in transcritical operation mode. The mode switch is typically based on user choice of a threshold temperature. In some systems, the threshold temperature is the critical temperature of the refrigerant (CO2). The subcritical mode is employed when the temperature of the refrigerant at an output of a gas cooler/condenser is below the critical temperature and the transcritical mode being used when the temperature of the refrigerant at the output of the gas cooler/condenser is at or above the critical temperature. Such two-mode control schemes may cause a system to switch back and forth between modes by itself even when the unit surrounding environmental conditions does not change at all, particularly when operation conditions are in the region near the critical temperature. the mode switch is typically based on user choice of a threshold temperature. For at least some heat reclaim applications, the unit may only operate in transcritical mode in order to boost heat production even at low ambient and low gas cooler exit CO2 temperature.

Additionally, at least some known systems attempt to use a high pressure valve (HPV) to control a pressure at the output of the gas cooler/condenser to a target pressure determined from the temperature of the refrigerant at the output of the gas cooler/condenser which is regulated by one or more fans. The changing pressure causes changes to the temperature of the refrigerant at the output of the gas cooler/condenser, which may result in the system changing the pressure target to a target determined from the new temperature, which will again cause the temperature to change. The fans will attempt to regulate the temperature, which will result in a change in the pressure. This "tail chasing" is often noticed when the gas cooler/condenser heat transfer performance is degraded or undersized and the temperature of the refrigerant at the output of the gas cooler/condenser does not follow the temperature of the air input to the gas cooler/condenser.

In subcritical mode, the subcooling at the gas cooler exit becomes a control target in some systems. This typically involve changing the control algorithm for the gas cooler pressure control valve as it now serves as a subcooling control valve. This also is a primary reason that two modes control method is often adopted for use in CO2 systems. To avoid instability in subcooling control, typically a minimal condensing pressure limit is imposed to run the system at a condensing temperature much higher than the inlet air temperature. As a result, the system runs at a lower efficiency to maintain stability.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF SUMMARY

One aspect of the present disclosure is CO2 refrigeration system including a compressor, a gas cooler/condenser, a flash tank, a bypass valve (BGV), and a controller. The gas cooler/condenser receives refrigerant discharged from the compressor and outputs a flow of refrigerant. The gas cooler/condenser is operable as a gas cooler when the CO2 refrigeration system is operating in a transcritical mode and as a condenser when the CO2 refrigeration system is operating in a subcritical mode. The flash tank is connected to receive refrigerant output from the gas cooler/condenser. The BGV is between the flash tank and a suction side of the compressor to control a flow of refrigerant from the flash tank to the suction side of the compressor. The controller includes a processor and a memory. The processor is configured by instructions stored in the memory to perform the steps of obtaining a target exit pressure of the refrigerant from the gas cooler/condenser, a measurement of a pressure of the flash tank, and an open percentage of the BGV; determining, based at least in part on the pressure of the flash tank and the open percentage of the BGV, whether or not to decrease the pressure of the flash tank; and increasing the target exit pressure by an amount when the controller determines to decrease the pressure of the flash tank.

Another aspect of this disclosure is a controller for a CO2 refrigeration system that includes a compressor, a gas cooler/condenser that receives refrigerant discharged from the compressor and outputs a flow of refrigerant, a flash tank connected to receive refrigerant output from the gas cooler/condenser, and a bypass valve (BGV) between the flash tank and a suction side of the compressor to control a flow of refrigerant from the flash tank to the suction side of the compressor. The controller includes a processor and a memory. The processor is configured by instructions stored in the memory to perform the steps of: obtaining a target exit pressure of the refrigerant from the gas cooler/condenser, a measurement of a pressure of the flash tank, and an open percentage of the BGV; determining, based at least in part on the pressure of the flash tank and the open percentage of the BGV, whether or not to decrease the pressure of the flash tank; and increasing the target exit pressure by an amount when the controller determines to decrease the pressure of the flash tank.

Another aspect of this disclosure is a method of controlling a CO2 refrigeration system including a compressor, a gas cooler/condenser that receives refrigerant discharged from the compressor and outputs a flow of refrigerant, a flash tank connected to receive refrigerant output from the gas cooler/condenser, and a bypass valve (BGV) between the flash tank and a suction side of the compressor to control a flow of refrigerant from the flash tank to the suction side of the compressor. The method includes: obtaining a target exit pressure of the refrigerant from the gas cooler/condenser, a measurement of a pressure of the flash tank, and an open percentage of the BGV; determining, based at least in part on the pressure of the flash tank and the open percentage of the BGV, whether or not to decrease the pressure of the flash tank; and increasing the target exit pressure by an amount when the controller determines to decrease the pressure of the flash tank.

Various refinements exist of the features noted in relation to the above-mentioned aspects. Further features may also be incorporated in the above-mentioned aspects. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

The following figures illustrate various aspects of the disclosure.

Corresponding reference characters indicate corresponding parts throughout the drawings.

DETAILED DESCRIPTION

Example embodiments will now be described more fully with reference to the accompanying drawings. For convenience, the embodiments will be described with respect to a $CO_2$ rack system using multiple compressor operating in parallel. However, the systems, controllers, and methods of this disclosure may be applied to any suitable $CO_2$ refrigeration system, including condenser units and systems incorporating condenser units.

Figure 1:
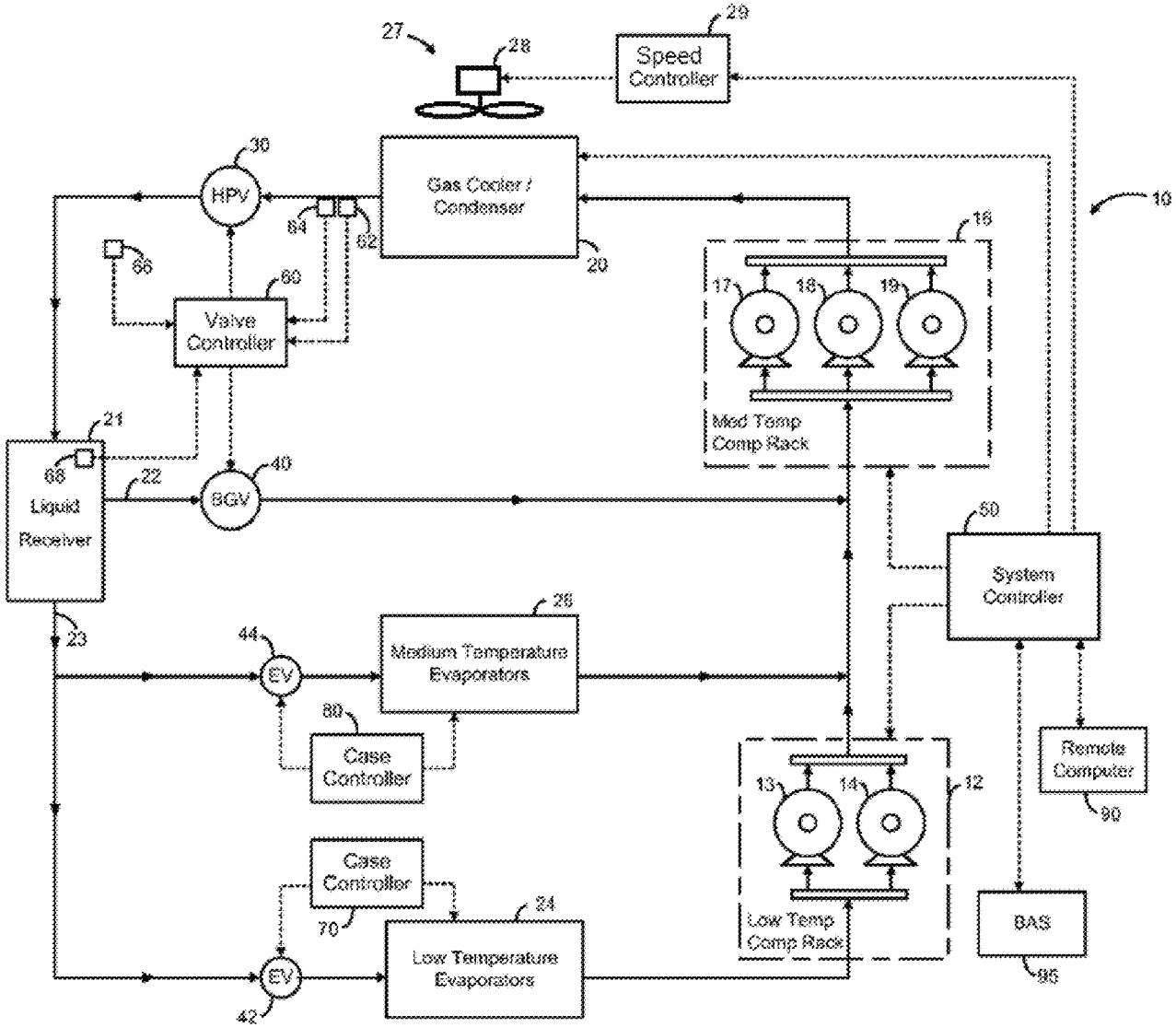
FIG. 1 is a schematic of an example $CO_2$ refrigeration system.

With reference to FIG. 1, an example $CO_2$ refrigeration system 10 is shown. The example system 10 is a medium temperature with boosted low temperature $CO_2$ refrigeration system, but other embodiments may include any other suitable $CO_2$ refrigeration system. The system 10 includes a low temperature compressor rack 12 with compressors 13, 14, and a medium temperature compressor rack 16 with compressors 17, 18, 19. The compressors 13, 14, 17, 18, 19 may be fixed capacity or variable capacity compressors. For example, each compressor rack 12, 16 may include at least one variable capacity compressor and at least one fixed capacity compressor. The compressors in each rack may be connected via appropriate suction and discharge headers. The low temperature compressor rack 12 may be connected in series with the medium temperature compressor rack 16 such that the refrigerant discharged from the low temperature compressor rack 12 is received on a suction side of the medium temperature compressor rack 16. The number of compressors shown is merely an example, other embodiments may include more or fewer compressors in each rack, including only one low temperature compressor and one medium temperature compressor.

Refrigerant (e.g., $CO_2$) discharged from the medium temperature compressor rack 16 is received by/input to a gas cooler/condenser 20. As described in further detail below, the refrigeration system 10 may be operable in a subcritical mode or in a transcritical mode. In the transcritical mode, the gas cooler/condenser 20 functions as a gas cooler. In the subcritical mode, the gas cooler/condenser 20 functions as a condenser. For simplicity, the gas cooler/condenser 20 may be referred to sometimes herein as a gas cooler or as a condenser without limiting the gas cooler/condenser 20 to only being operable or currently being operated as a gas cooler or as a condenser.

A fan 27 provides a flow of air into the gas cooler/condenser 20. The fan includes a motor 28 under the control of a speed controller 29. The speed controller 29 controls the speed of the motor 28 to control the flow of air into the gas cooler/condenser 20 in response to instructions from the system controller 50. In other embodiments, the speed controller 29 is incorporated in the system controller 50. In various embodiments, the fan 27 is a component of the gas cooler/condenser 20.

Refrigerant output from the gas cooler/condenser 20 is received by liquid receiver 21 (sometimes referred to as a flash tank). Liquid receiver 21 is connected to a first discharge line 22 that routes gaseous refrigerant from the liquid receiver 21 back to the suction side of the medium temperature compressor rack 16. The liquid receiver 21 is also connected to a second discharge line 23 that routes liquid refrigerant from the liquid receiver 21 to evaporators 24, 26.

Refrigerant routed from the liquid receiver 21 via the second discharge line 23 is received by the low temperature evaporators 24 and the medium temperature evaporators 26. The low temperature evaporators 24 may include, for example, grocery store freezers or frozen food cases. The medium temperature evaporators 26 may include, for example, dairy or meat cases.

Refrigerant from the low temperature evaporator 24 is then discharged to the suction side of the low temperature compressor rack 12. Refrigerant from the medium temperature evaporators 26 is then discharged to the suction side of the medium temperature compressor rack 16. The refrigeration cycle then starts anew.

The refrigeration system 10 may include various valves, controlled by various associated controllers, to monitor and regulate the various temperatures and pressures within the refrigeration system 10 to maintain efficient and desirable operation.

Specifically, refrigeration system 10 includes a high pressure valve (HPV) 30 and a bypass gas valve (BGV) 40. As shown in FIG. 1, the HPV 30 is connected between the output of gas cooler/condenser 20 and the liquid receiver 21. The BGV 40 is located on the first discharge line 22 between the liquid receiver 21 and the suction side of the medium temperature compressor rack 16. As described in further detail below, HPV 30 and BGV 40 are adjusted and controlled to maintain certain system operating conditions for efficient and desirable operation. For example, the HPV 30 controls the flow of refrigerant from the gas cooler/condenser 20 to the liquid receiver 21. The BGV 40 controls the flow of refrigerant from the liquid receiver 21 to the suction side of the medium temperature compressor rack 16. The HPV 30 and the BGV 40 may include, for example, associated stepper motors for variable adjustment of the valve openings.

The low temperature evaporators 24 and the medium temperature evaporators 26 each include an associated expansion valve (EV) 42, 44.

The refrigeration system 10 includes various controllers that monitor operating and environmental conditions, including temperature and pressures, and control the various system components according to programmed control strategies. Specifically, a system controller 50 controls the compressor racks 12, 16 by activating, deactivating, and adjusting the compressors 13, 14, 17, 18, 19, of the compressor racks 12, 16. The system controller 50 also controls the gas cooler/condenser 20 by activating, deactivating, and adjusting fans of the gas cooler/condenser 20. The system controller 50 may be any suitable controller including a processor and memory storing appropriate instructions executable by the processor to program the processor to operate in accordance with the present disclosure. The system controller 50 may include a user interface, such as a touchscreen or a display screen and user input device, such as a keyboard, to communicate with a user. For example, the system controller 50 may output system parameters, such as system operating temperatures or pressures, and/or system setpoints to a user. Further, the system controller 50 may receive user input modifying the system setpoints or control algorithms.

The refrigeration system 10 includes a valve controller 60 programmed to control the HPV 30 and the BGV 40. Although illustrated as a separate component, in some embodiments, some or all functions of the valve controller may be included in the system controller 50, actions ascribed to the valve controller 60 may be performed by the system controller 50, and/or the system controller may be communicatively coupled to the valve controller 60 to control the HPV and/or the BGV by instructing the valve controller 60. The valve controller 60 is connected to various temperature and pressure sensors to monitor system and environmental conditions. Specifically, the valve controller 60 is connected to a refrigerant temperature sensor 62 that senses an exit temperature of refrigerant exiting the gas cooler/condenser 20. The valve controller 60 is also connected to a refrigerant pressure sensor 64 that senses an exit pressure of refrigerant exiting the gas cooler/condenser 20. While separate pressure and temperature sensors are shown in FIG. 1, alternatively a single combination refrigerant pressure and temperature sensor could be used to sense both the pressure and temperature of refrigerant exiting the gas cooler/condenser 20. The valve controller 60 is also connected to a temperature sensor 66 that senses a temperature of the flow of air from the fan 27 into to the gas cooler/condenser 20, sometimes referred to as the inlet air temperature. In other embodiments, the temperature sensor 66 senses an outdoor ambient temperature, which may be the temperature of the air that will be directly or indirectly input to the gas cooler/condenser. The valve controller 60 is also connected to a liquid receiver pressure sensor 68 that senses a pressure of refrigerant within the liquid receiver 21 (also sometimes referred to as a flash tank pressure). As discussed in further detail below, the valve controller 60 controls the openings of the HPV 30 and BGV 40 to maintain efficient and desirable operation of the refrigeration system 10 in both subcritical and transcritical modes.

The valve controller 60 may be any suitable controller having appropriate programming in accordance with the present disclosure for controlling the HPV 30 and BGV 40. Further, the valve controller 60 may include a user interface, such as a touchscreen or a display screen and user input device, such as a keyboard, to communicate with a user. For example, the valve controller 60 may output system parameters, such as system operating temperatures or pressures, and/or system setpoints to a user. Further, the valve controller 60 may receive user input modifying the system setpoints or control algorithms.

The refrigeration system 10 also includes case controllers 70, 80 for controlling the low temperature evaporators 24 and medium temperature evaporators 26 and the associated expansion valves 42, 44. For example, the case controllers 70, 80 may activate, deactivate, and adjust the evaporator fans of the evaporators 24, 26. The case controllers may also adjust the expansion valves 42, 44. The case controllers 70, 80 may be any suitable controller with appropriate programming in accordance with the present disclosure. Moreover, the case controllers may be implemented as part of the system controller 50. Further, the case controllers 70, 80 may include a user interface, such as a touchscreen or a display screen and user input device, such as a keyboard, to communicate with a user. For example, the case controllers 70, 80 may output system parameters, such as system operating temperatures or pressures, and/or system setpoints to a user. Further, the case controllers 70, 80 may receive user input modifying the system setpoints or control algorithms.

Each of the controllers shown in FIG. 1 is operable to communicate with each other. For example, the system controller 50 may adjust operation or setpoints of the valve controller 60 and the case controllers 70, 80. Further, if a local sensor of the valve controller 60 fails, it may communicate with the system controller 50 or the case controllers 70, 80 to adjust operation accordingly. For example, if the local temperature sensor 66 of the valve controller 60 fails, it may communicate with the system controller 50 or the case controllers 70, 80 to receive inlet air temperature data or ambient air temperature data from a temperature sensor connected or accessible to the system controller 50 or the case controllers 70, 80. Further, as noted above, the valve controller and case controllers 70, 80 may be implemented (as hardware, software, or both) in the system controller 50 in whole or in part and the system controller 50 may perform the functions ascribed herein to the other controllers. In some embodiments, the system controller 50 performs some or all of the actions of the other controllers by instructing the valve controller 60 and/or the case controllers 70, 80 to perform the operations.

Additionally, a remote computer 90 may be connected to the system controller 50 so that a remote user can log into the system controller 50 and monitor, control, or adjust operation of any of the controllers, including the system controller 50, the valve controller 60, and the case controllers 70, 80.

Additionally, the system controller 50 may be in communication with a building automation system (BAS) 95. The BAS 95 may be connected to additional temperature and pressure sensors and may monitor and store additional temperature and pressure data that can be accessed by the system controller 50, and/or the valve controller 60, in the event of a sensor failure. The remote computer 90 can also be connected to the BAS 95 so that a remote user can log into the BAS 95 and monitor, control, or adjust operation of any of the controllers, including the system controller 50, the valve controller 60, and the case controllers 70, 80.

Figure 2:
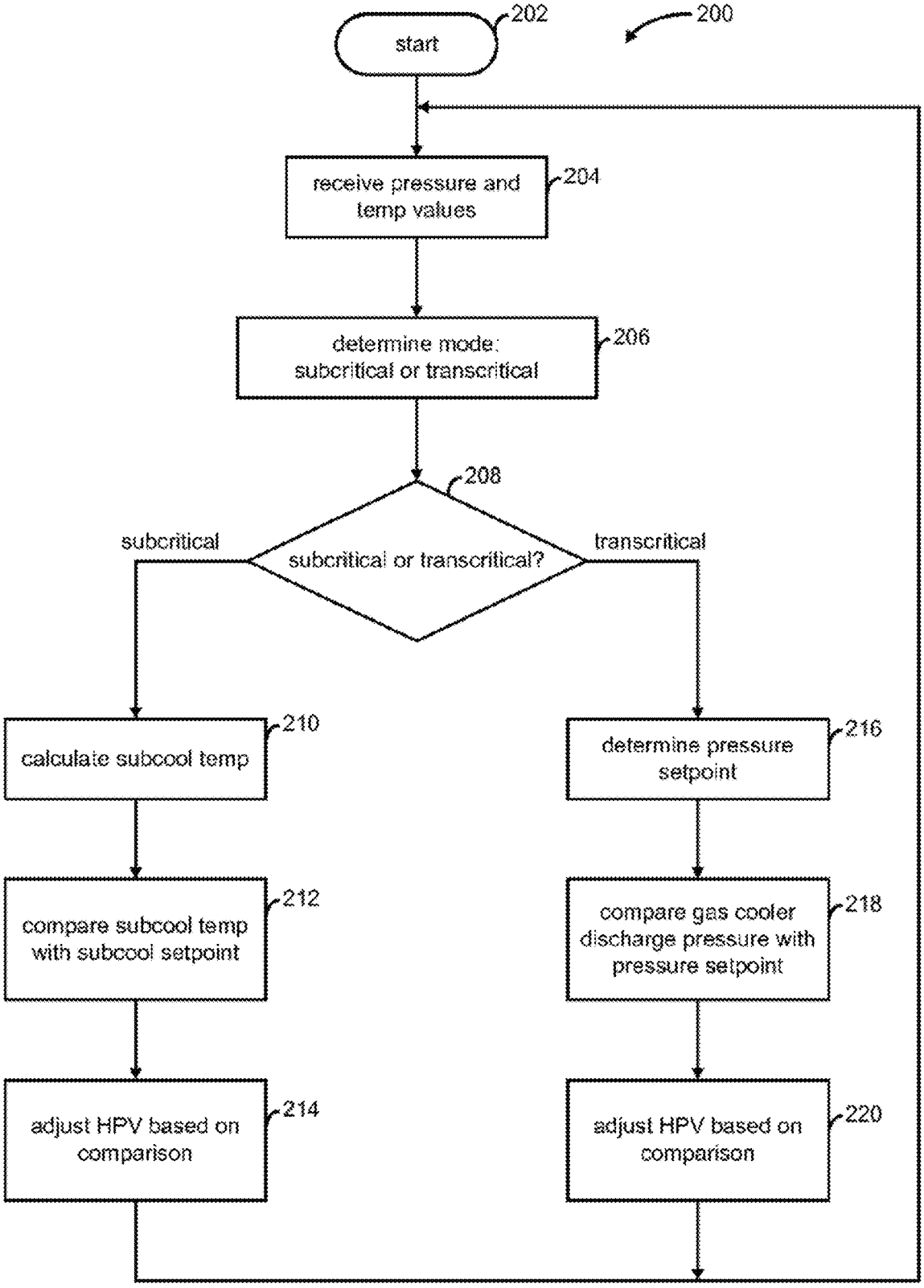
FIG. 2 (Prior Art)
FIG. 2 is a flowchart of a prior art control algorithm for gas cooler control of the $CO_2$ refrigeration system of FIG. 1.

With reference to FIG. 2, a prior art control algorithm 200 is shown for adjusting the HPV 30. The control algorithm 200 may be performed by valve controller 60. Alternatively, the control algorithm 200 may be performed by system controller 50, which may output appropriate control signals to valve controller 60 or directly to the HPV 30. During operation of the system using the control algorithm 200, the fan speed is controlled by the speed controller 29 using a non-feedback control based on air inlet temperature or other criteria. The control algorithm 200 starts at 202. At 204, the valve controller 60 receives pressure and temperature values from the connected pressure and temperature sensors 62, 64, 66, 68. Specifically, the valve controller 60 receives data indicating the pressure and temperature of refrigerant exiting the gas cooler/condenser 20, the ambient air temperature, and the pressure within the liquid receiver 21. In this prior art example, the sensor 66 is an outdoor ambient temperature sensor.

At 206, the valve controller 60 determines whether the refrigeration system 10 is operating in a subcritical or a transcritical mode. For example, valve controller 60 may compare a current system or operating condition with a particular system or operating condition setpoint. As an example, valve controller 60 may compare the current ambient air temperature with a temperature setpoint to determine whether the refrigeration system 10 is in subcritical or transcritical mode. When air temperature is above the temperature setpoint, the valve controller 60 may determine that the refrigeration system 10 is in transcritical mode. When the air temperature is below the temperature setpoint, the valve controller 60 may determine that the refrigeration system 10 is in subcritical mode. For example, the temperature setpoint may be 14 degrees Celsius. As another example, the valve controller 60 may compare the current air temperature with the temperature setpoint minus a predetermined hysteresis value. In such case, for example, the temperature setpoint may be 21 degrees Celsius and the hysteresis value may be 7 degrees Celsius. Both the temperature setpoint and the hysteresis value may be user configurable. Alternatively, the valve controller 60 may make the determination by comparing the current temperature and/or pressure of refrigerant exiting the gas cooler/condenser 20 with a temperature or pressure setpoint. Alternatively, the valve controller 60 may evaluate the air temperature in combination with the pressure and/or temperature of refrigerant exiting the gas cooler/condenser 20 to make the determination as to whether the refrigeration system 10 is operating in a subcritical mode or a transcritical mode.

At 208, when the refrigeration system 10 is in subcritical mode, the valve controller 60 proceeds to 210. At 210, the valve controller 60 calculates a current subcooling temperature based on the temperature and pressure of refrigerant exiting the gas cooler/condenser 20. Specifically, based on the temperature and pressure of refrigerant exiting the gas cooler/condenser 20, the valve controller 60 can determine the critical point of the refrigerant. The valve controller 60 may then compare the critical point of the refrigerant with the current temperature of the refrigerant exiting the gas cooler/condenser 20. The valve controller 60 may determine the subcooling temperature value to be the difference between the critical point of the refrigerant and the current temperature of the refrigerant exiting the gas cooler/condenser 20.

At 212, the valve controller 60 compares the subcooling temperature with a subcooling temperature setpoint and determines a difference between the two values. For example, the subcooling temperature setpoint may be 10 degrees Celsius.

At 214, the valve controller 60 adjusts the HPV 30 based on the comparison. Specifically, the valve controller 60 adjusts the HPV 30 to drive the current subcooling temperature value toward the subcooling temperature setpoint. The valve controller 60 may use a PID control algorithm, a PI control algorithm, fuzzy logic, or a neural network type control system/algorithm to make appropriate adjustments to the HPV 30. After adjusting the HPV 30, the valve controller loops back to 204.

At 208, when the refrigeration system 10 is in transcritical mode, the valve controller 60 proceeds to 216. At 216, the valve controller 60 determines a pressure setpoint. For example, the valve controller 60 may reference a lookup table that includes pressure setpoints indexed based on a system or environmental operating condition. For example, the lookup table may include pressure setpoints indexed based on ambient air temperature. As such, valve controller 60 may determine the current ambient air temperature and may access the lookup table to determine the corresponding pressure setpoint. If the current ambient air temperature is between table entries, the valve controller 60 may interpolate a pressure setpoint based on the nearest table entries. The lookup table may be stored in a memory included in, or accessible to, the valve controller 60. For example, the lookup table may be stored at the system controller 50 and the valve controller 60 may query the system controller 50 to obtain the pressure setpoint. Alternatively, the lookup table may include pressure setpoints indexed based on a temperature or pressure of refrigerant exiting the gas cooler/condenser 20, or another system or environmental operating temperature or pressure.

The lookup table may be specific to, and optimized for, a particular model, size, or type of compressor(s) or other system component(s). For example, the system controller 50 may query the individual compressors 13, 14, 17, 18, 19 in the compressor racks 12, 16 or the system controller 50 to identify the compressors present in the refrigeration system 10 and may determine the most appropriate lookup table, or may generate an installation specific lookup table, based on the identified compressors included in the refrigeration system 10. For example, each compressor 13, 14, 17, 18, 19 may include an individual compressor controller and/or a non-volatile memory with sufficient identification information identifying the model, size, or type of compressor. The identification information may be utilized to determine the most appropriate lookup table. Specific lookup tables may be generated beforehand based on field data or experimental data, and/or based on modeled data corresponding to operation of individual compressor models, sizes, types, etc. Further, models for specific compressors may be generated based on field data and/or experimental data, and then interpolated to other similar compressors.

Alternatively, valve controller 60 may calculate the pressure setpoint as a function of the inlet air temperature. Alternatively, valve controller 60 may determine the pressure setpoint based on other system or environmental data, such as the temperature or pressure of the refrigerant exiting the gas cooler/condenser 20.

At 218, the valve controller 60 compares the pressure of refrigerant exiting the gas cooler/condenser 20 with the determined pressure setpoint. At 220, the valve controller 60 then controls the HPV 30 based on the comparison. Specifically, the valve controller 60 adjusts the HPV 30 to drive the current pressure value toward the determined pressure setpoint. The valve controller 60 may use a PID control algorithm, a PI control algorithm, fuzzy logic, or a neural network type control system/algorithm to make appropriate adjustments to the HPV 30. After adjusting the HPV 30, the valve controller loops back to 204.

Figure 3:
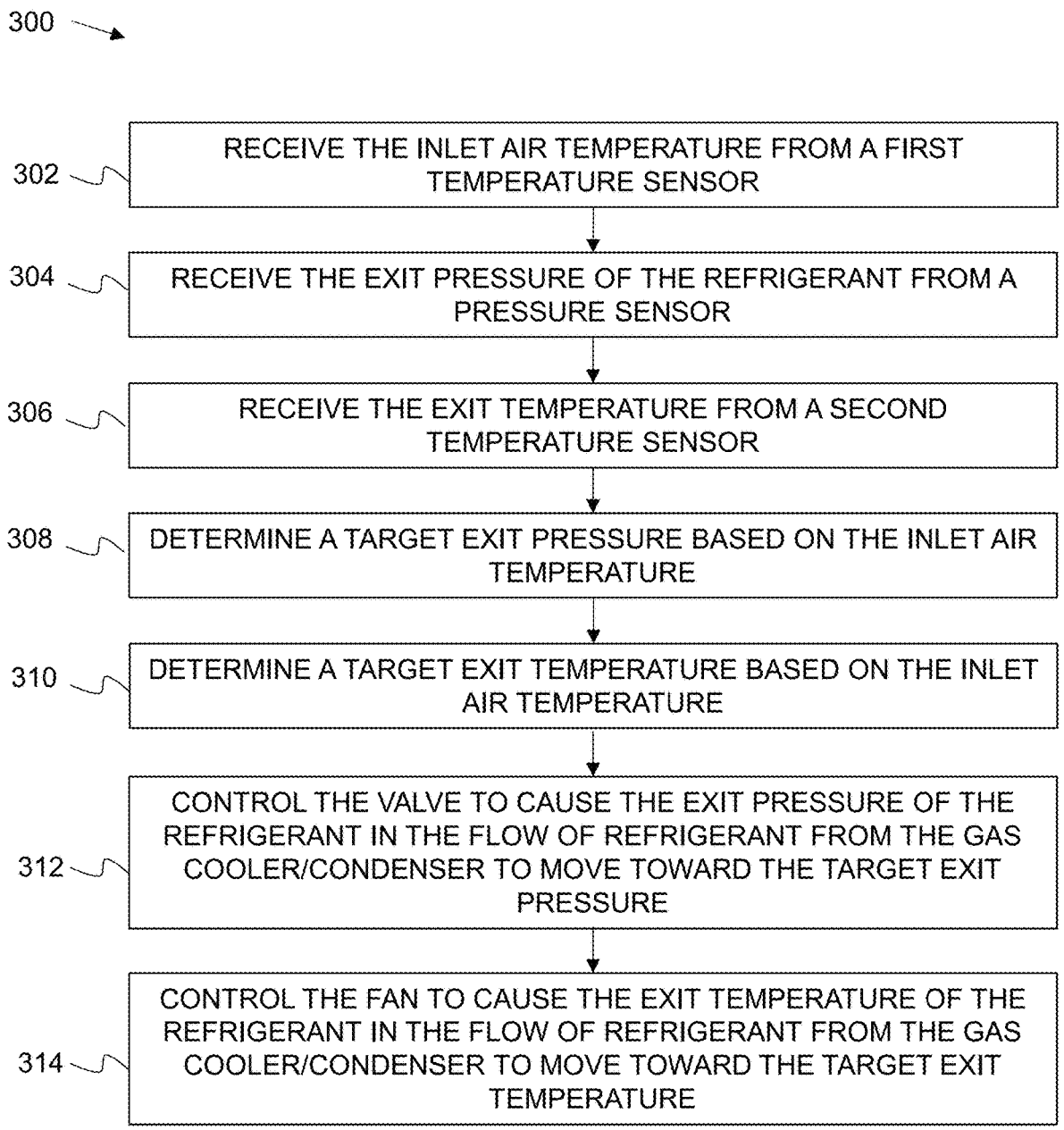
FIG. 3 is a flowchart of an example control algorithm of this disclosure for the $CO_2$ refrigeration system of FIG. 1.

FIG. 3 is a flow diagram of a control algorithm 300 of the present disclosure for controlling a CO2 refrigeration system, such as the system 10 in FIG. 1. In this example, the temperature sensor 66 is an inlet air temperature sensor that senses the temperature of the flow of air from the fan 27 into to the gas cooler/condenser 20. The control algorithm 300 will be described as being performed by system controller 50 in the example embodiment. In other embodiments, the control algorithm 300 may be performed by valve controller 60 and speed controller 29.

At 302, the controller 50 receives the inlet air temperature from the temperature sensor 66. At 304, the controller 50 receive the exit pressure of the refrigerant in the flow of refrigerant from the gas cooler/condenser from the pressure sensor 64, and the controller 50 receives the exit temperature of the refrigerant in the flow of refrigerant from the gas cooler/condenser from the temperature sensor 62.

The controller 50 determines a target exit pressure (also referred to as an exit pressure setpoint) based on the received inlet air temperature at 310. The target exit pressure may be determined by calculation using an equation with the inlet air temperature as the input. Any equation that relates inlet air temperature to desired exit pressure may be used. In an example embodiments, the equation is a fifth order polynomial equation. In other embodiments, the controller 50 determines the target exit pressure using a lookup table stored in the memory of the controller 50. The lookup table may include specific target exit pressures for specific inlet air temperature. Controller 50 may access the lookup table to determine the target exit pressure corresponding to the inlet air temperature. If the received inlet air temperature is between table entries, the controller 50 may interpolate a target exit pressure based on the nearest table entries. The lookup table may be specific to, and optimized for, a particular model, size, or type of compressor(s) or other system component(s). For example, the system controller 50 may query the individual compressors 13, 14, 17, 18, 19 in the compressor racks 12, 16 or the system controller 50 to identify the compressors present in the refrigeration system 10 and may determine the most appropriate lookup table, or may generate an installation specific lookup table, based on the identified compressors included in the refrigeration system 10. For example, each compressor 13, 14, 17, 18, 19 may include an individual compressor controller and/or a non-volatile memory with sufficient identification information identifying the model, size, or type of compressor. The identification information may be utilized to determine the most appropriate lookup table. In other embodiments, a user or installer may identify the equipment to the controller 50, may select a particular lookup table to use, may modify an existing table, or may create a unique table. Specific lookup tables may be generated beforehand based on field data or experimental data, and/or based on modeled data corresponding to operation of individual compressor models, sizes, types, etc. Further, models for specific compressors may be generated based on field data and/or experimental data, and then interpolated to other similar compressors.

In some embodiments, the controller 50 determines the target exit pressure by determining the saturation pressure of the refrigerant at a calculated temperature that is the sum of the inlet air temperature and a preset temperature differential. In one example, the preset temperature differential is about eleven degrees Fahrenheit. In other embodiments, other preset temperature differentials may be used. The controller 50 determines the saturation pressure at the calculated temperature using an equation, a lookup table, or by any other suitable technique.

In some embodiments, the controller 50 determines the target exit pressure based on the received exit temperature. The target exit pressure may be determined by calculating the subcooling with the exit temperature as the input. Any equation that relates the exit temperature to desired exit pressure may be used. In other embodiments, the controller 50 determines the target exit pressure using a lookup table similar to that discussed above stored in the memory of the controller 50 and including specific target exit pressures for specific exit temperatures.

For $CO_2$, 1070 pounds per square inch absolute (PSIA) is the critical pressure of the fluid and setting the target exit pressure near that pressure should be avoided. Thus, the controller 50 is configured to determine the target exit pressure to avoid a target exit pressure of 1070 PSIA plus or minus a preset pressure difference. In one example, the preset pressure difference is ±30 PSIA. In other embodiments, the preset pressure difference may be any other suitable value and may be use/installer configurable. If the calculated target exit pressure would be within the forbidden range of pressures, the controller 50 may round the target exit pressure (up or down) to a value outside of the range of 1070 PSIA plus or minus the preset pressure differential.

In above pressure target setting, the compressor operation envelope's limitation on the lowest discharge pressure can also be incorporated in the lookup table or the maximum value of this low limit pressure with the suggested discharge pressure may be used to make sure compressor will not operate outside its envelope.

At 310, the controller 50 determines a target exit temperature based on the received inlet air temperature. In the example embodiment, if the inlet air temperature is greater than or equal to a preset temperature threshold, the controller determines the target exit temperature as a sum of the inlet air temperature and a preset first air temperature differential. Typically, the temperature differential can be set as zero or close to zero to provide a 100% fan speed output when the pressure target is above critical pressure. When the pressure target is below the critical pressure, the maximum subcooling at the gas cooler exit or the minimum temperature target is determined by the saturation liquid enthalpy at liquid receiver pressure or can be calculated as average of the saturation temperature at gas cooler pressure and the saturation temperature at liquid receiver pressure as a simple implementation. In the example embodiment, the preset temperature threshold is seventy-seven degrees Fahrenheit. Other embodiments may use any other suitable temperature threshold. If the inlet air temperature is less than the preset temperature threshold, the controller 50 sets the target exit temperature as the saturation temperature of the refrigerant at the target exit pressure determined above minus a preset second air temperature differential.

After setting the target exit pressure and the target exit temperature, at 312 the controller 50 controls HPV 30 to cause the exit pressure of the refrigerant in the flow of refrigerant from the gas cooler/condenser 20 to move toward the target exit pressure. At 314, the controller 50 controls the fan 27 to cause the exit temperature of the refrigerant in the flow of refrigerant from the gas cooler/condenser 20 to move toward the target exit temperature by selectively increasing or decreasing the speed of the motor 28. The speed of the fan motor may be set/controlled directly by the controller 50, or the controller 50 may command the speed control 29 to control the fan motor to 100%. In the example embodiment, if the inlet air temperature is above or equal to the preset temperature threshold, the controller sets the speed of the motor 28 of the fan 27 to 100%.

Thus, the controller 50 of the present disclosure controls the HPV 30 and the fan 27 based on the inlet air temperature both when the $CO_2$ refrigeration system is operating in the transcritical mode and when the $CO_2$ refrigeration system is operating in the subcritical mode. That is, the controller 50 uses both the HPV 30 and the fan 27 together to control the system, does so based on the inlet air temperature, does not need to determine if the system is in the transcritical mode or the subcritical mode, and does not need two different control schemes for the two different modes.

The control techniques described herein may avoid the artificial low limit of gas cooler condensing temperature at low ambient conditions that is found in at least some known systems, which may improve the system efficiency at low ambient condition. In some known systems controller, there is a low limit of gas cooler condensing temperature of 15° C. (59° F.) being set no matter how low the ambient (or inlet) air temperature is in order to avoid system instability. This hurts the system efficiency due to running the system at a higher than needed condensing pressure. In the systems of the current application, the HPV is adjusted to bring the reading of the exit pressure sensor to its target. The fan speed controller is used to bring the reading of the exit temperature sensor to its target. When both sensors are controlled to their target, the subcooling requirement is automatically satisfied without the need for the artificial low limit found on other known systems. Thus, the systems of the current disclosure may operate at a lower condensing pressure at low ambient condition to improve the system efficiency.

Optimal gas cooler pressure at given gas cooler exit temperature may also be maintained by using the control schemes described herein. Although gas cooler/condenser exit pressure target is not set directly from the reading of the gas cooler/condenser exit temperature in transcritical operation as is done in some known systems, the embodiments of this disclosure established will still satisfy optimal gas cooler pressure at given gas cooler exit temperature for CO2 transcritical operation when both pressure target and temperature target are reached in a stable operation.

Figure 4:
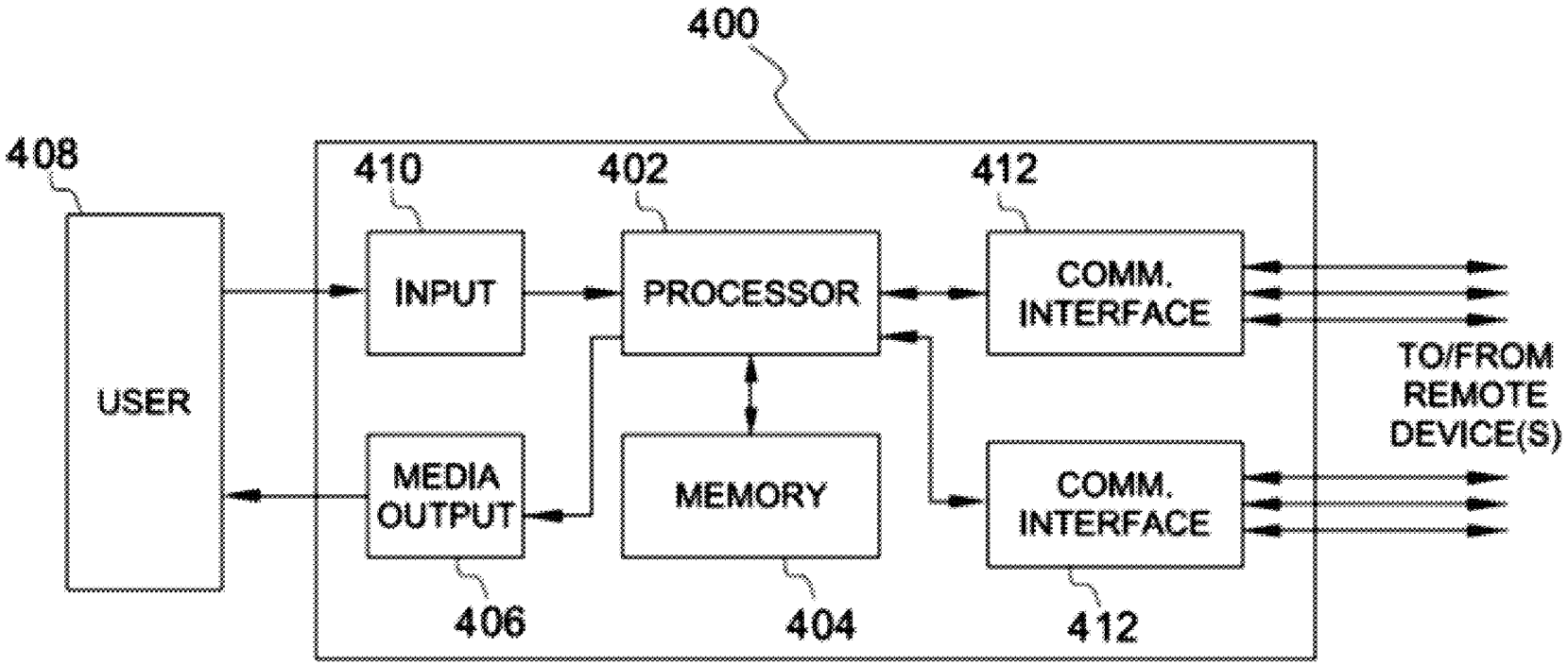
FIG. 4 is an example controller for use in the $CO_2$ refrigeration system of FIG. 1.

FIG. 4 is an example configuration of a computing device 400 for use as a controller (e.g., as the control system 50, the valve controller 60, the speed controller, and the like) in the $CO_2$ refrigeration system 10. The computing device 400 includes a processor 402, a memory 404, a media output component 406, an input device 410, and communications interfaces 412. Other embodiments include different components, additional components, and/or do not include all components shown in FIG. 4.

The processor 402 is configured for executing instructions. In some embodiments, executable instructions are stored in the memory 404. The processor 402 may include one or more processing units (e.g., in a multi-core configuration). The memory 404 is any device allowing information such as executable instructions and/or other data to be stored and retrieved. The memory 404 may include one or more computer-readable media.

The media output component 406 is configured for presenting information to user 408. The media output component 406 is any component capable of conveying information to the user 408. In some embodiments, the media output component 406 includes an output adapter such as a video adapter and/or an audio adapter. The output adapter is operatively connected to the processor 402 and operatively connectable to an output device such as a display device (e.g., a liquid crystal display (LCD), organic light emitting diode (OLED) display, cathode ray tube (CRT), "electronic ink" display, one or more light emitting diodes (LEDs)) or an audio output device (e.g., a speaker or headphones).

The computing device 400 includes, or is connected to, the input device 410 for receiving input from the user 408. The input device is any device that permits the computing device 400 to receive analog and/or digital commands, instructions, or other inputs from the user 408, including visual, audio, touch, button presses, stylus taps, etc. The input device 410 may include, for example, a variable resistor, an input dial, a keyboard/keypad, a pointing device, a mouse, a stylus, a touch sensitive panel (e.g., a touch pad or a touch screen), a gyroscope, an accelerometer, a position detector, or an audio input device. A single component such as a touch screen may function as both an output device of the media output component 406 and the input device 410.

The communication interfaces 412 enable the computing device 400 to communicate with remote devices and systems, such as sensors, 62, 64, 66, valve controller 60, speed controller 29, compressor racks 16, 12, remote computing device 90, BAS 95, and the like. The communication interfaces 412 may be wired or wireless communications interfaces that permit the computing device to communicate with the remote devices and systems directly or via a network. Wireless communication interfaces 412 may include a radio frequency (RF) transceiver, a Bluetooth® adapter, a Wi-Fi transceiver, a ZigBee® transceiver, a near field communication (NFC) transceiver, an infrared (IR) transceiver, and/or any other device and communication protocol for wireless communication. (Bluetooth is a registered trademark of Bluetooth Special Interest Group of Kirkland, Washington; ZigBee is a registered trademark of the ZigBee Alliance of San Ramon, California.) Wired communication interfaces 412 may use any suitable wired communication protocol for direct communication including, without limitation, USB, RS232, I2C, SPI, analog, and proprietary I/O protocols. In some embodiments, the wired communication interfaces 412 include a wired network adapter allowing the computing device to be coupled to a network, such as the Internet, a local area network (LAN), a wide area network (WAN), a mesh network, and/or any other network to communicate with remote devices and systems via the network.

Figure 5:
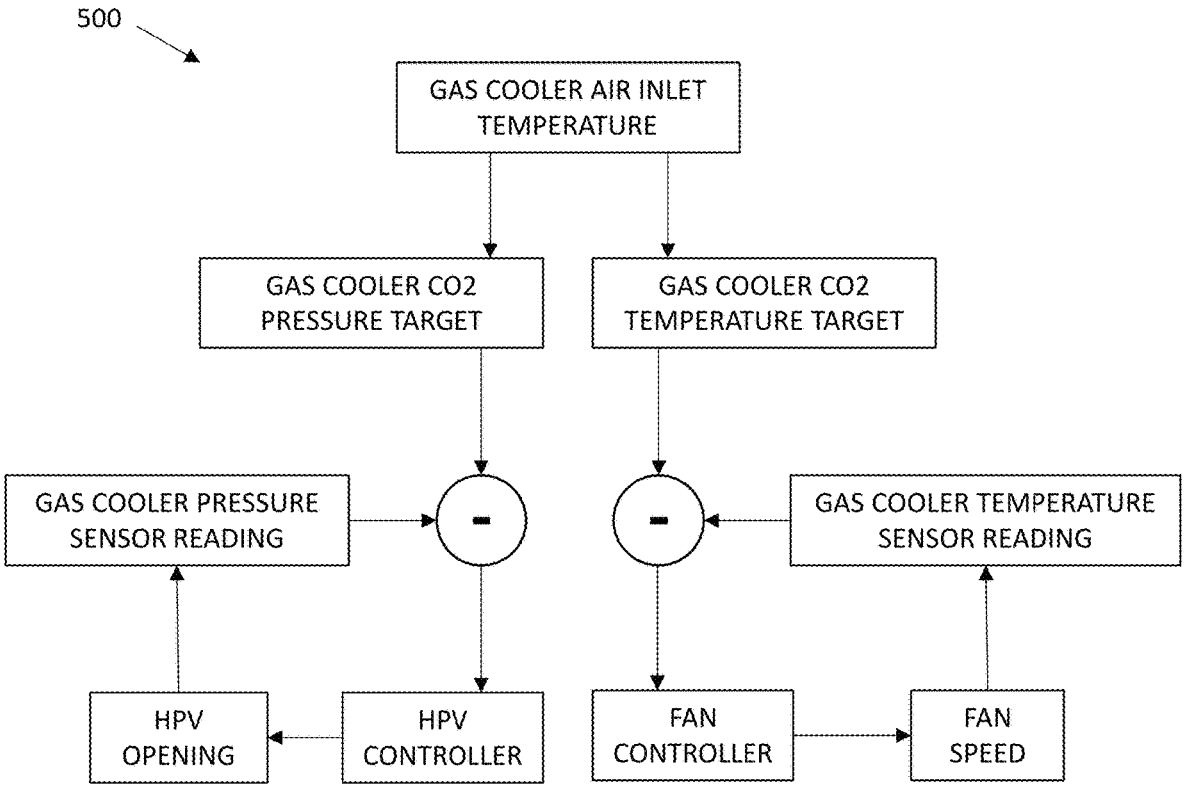
FIG. 5 is a flowchart of another example control algorithm of this disclosure for the $CO_2$ refrigeration system of FIG. 1.

FIG. 5 is a flow diagram of a control algorithm 500 of the present disclosure for controlling a CO2 refrigeration system, such as the system 10 in FIG. 1. In this algorithm, the gas cooler inlet air temperature reading is used to set the $CO_2$ exit temperature target. The gas cooler pressure target can be set by using the desired subcooling to determine the pressure target in the subcritical case and the optimal pressure for COP correlation can be used to setup the target in the transcritical case. Critical pressure is avoided in both cases. The valve controller 60 controls the HPV 30 using only feedback pressure control and the speed controller 29 controls the fan 27 using only feedback temperature control.

As explained above, at least some existing CO2 systems attempt to use both the fan 27 and HPV 30 to operate independently from each other, which may cause thermodynamic instability because gas cooler/condenser temperature and pressure affect each other and cannot operate independently. This issue is amplified in low ambient temperature conditions. Moreover, at low ambient conditions, this regulation may cause the gas cooler/condenser temperature and pressure to fall below the minimum condensing pressure of the system's compressor. A stable method for controlling a CO2 refrigeration system to account for low ambient temperature conditions will be described below with respect to the system 10 in FIG. 1. The method may be applied to any suitable CO2 refrigeration system and may be used in connection with the methods 300, 500 described above or in connection with any other suitable control method.

Figure 6:
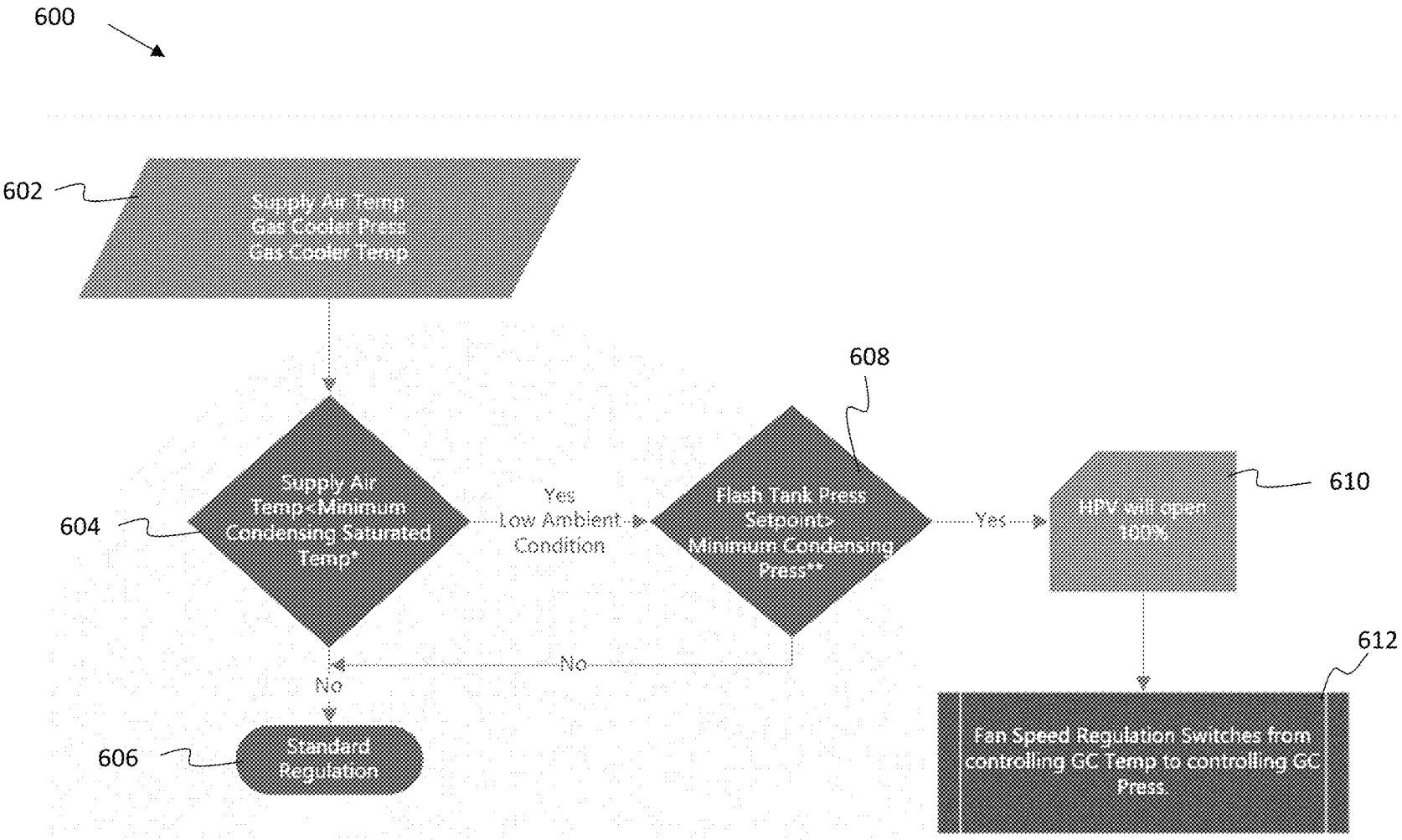
FIG. 6 is a flow diagram of an example control algorithm of the present disclosure for controlling the CO2 refrigeration system of FIG. 1.

FIG. 6 is a flow diagram of an example control algorithm 600 of the present disclosure for controlling a CO2 refrigeration system, such as the system 10 in FIG. 1. The control algorithm 600 will be described as being performed by system controller 50 in the example embodiment. In other embodiments, the control algorithm 600 may be performed by valve controller 60 and speed controller 29. In this example, the temperature sensor 66 is an inlet air temperature sensor that senses the temperature of the flow of air from the fan 27 into to the gas cooler/condenser 20.

At 602, the controller 50 receives the inlet air temperature from the temperature sensor 66 (also referred to as supply air temperature), the exit pressure of the refrigerant in the flow of refrigerant from the gas cooler/condenser from the pressure sensor 64, and the exit temperature of the refrigerant in the flow of refrigerant from the gas cooler/condenser from the temperature sensor 62.

The controller 50 determines, at 604, whether or not the inlet air temperature is less than a minimum condensing saturated temperature of the system's compressor. The minimum condensing saturated temperature is a temperature threshold where a supply air temperature below the threshold is considered a low ambient temperature condition. The minimum condensing saturated temperature is calculated from the minimum condensing pressure from the compressor envelope in the example embodiment. In other embodiments, a fixed temperature may be used instead of the minimum condensing saturated temperature, the minimum condensing saturated temperature may be retrieved from a lookup table, or may be calculated/determined by any other suitable method.

Figure 7:
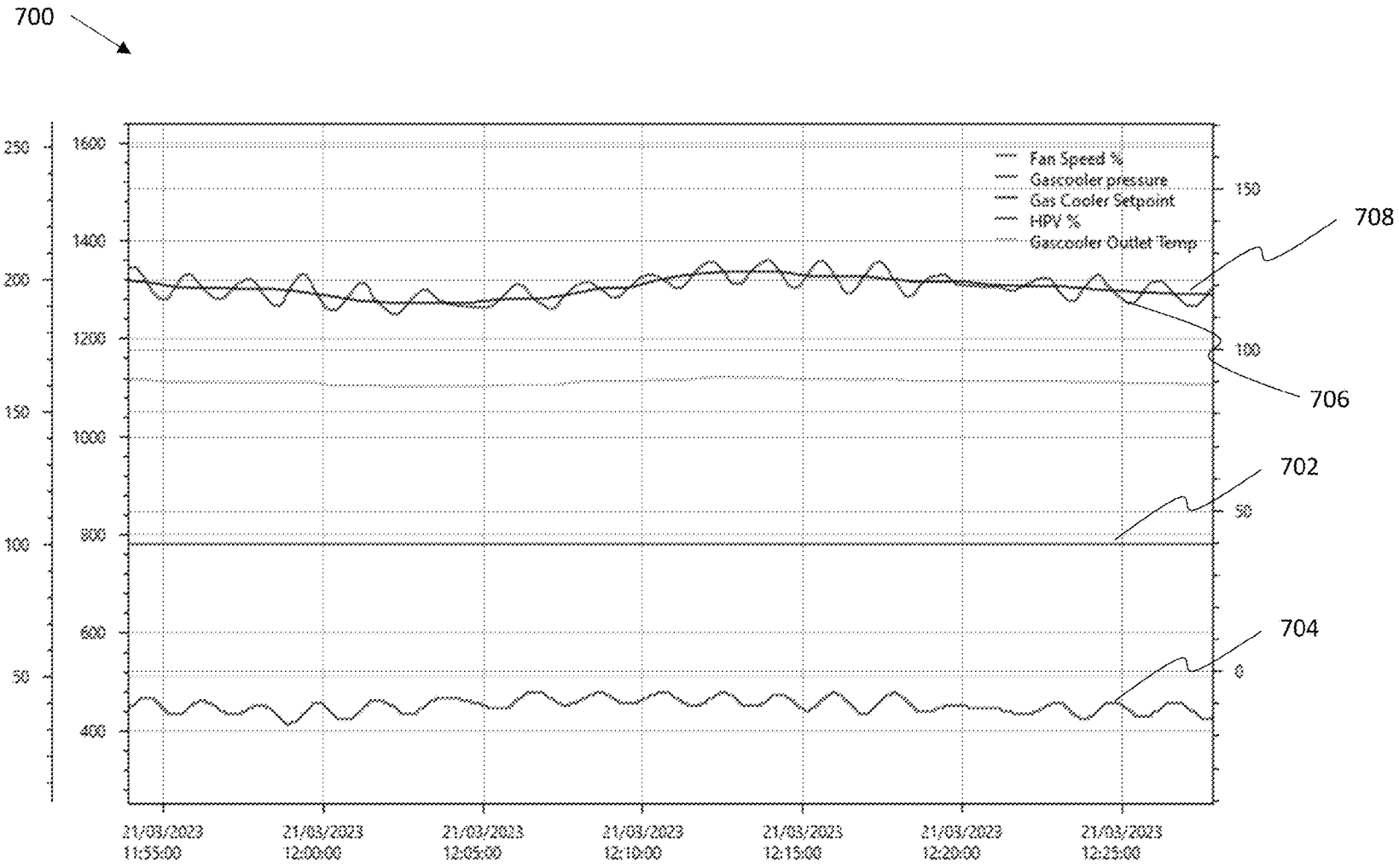
FIG. 7 is a graph of the fan speed percentage, the HPV open percentage, the exit pressure of the refrigerant in the flow of refrigerant from the gas cooler/condenser, and the target exit pressure for the system of FIG. 1 operated according to the algorithm of FIG. 6 at an ambient temperature of about 60° F.

If the inlet air temperature is not less than the minimum condensing saturated temperature (i.e., is greater than or equal to the minimum condensing saturated temperature), the controller 50 operates the system 10 according to its standard operation at 606. Thus, for example, when used in connection with the control algorithm 300, the controller 50 will control HPV 30 to cause the exit pressure of the refrigerant in the flow of refrigerant from the gas cooler/condenser 20 to move toward the target exit pressure. In this embodiment, the controller 50 commands the speed control 29 to control the fan motor 28 to 100% when the inlet air temperature is greater than a minimum condensing saturated temperature, leaving the HPV 30 as the only variable to be controlled and the fan operation insuring subcooling. This operation is shown in the graph 700 in FIG. 7. In the graph 700, the fan speed percentage 702 is constant at 100%, and the HPV open percentage 704 is controlled to cause the exit pressure 706 of the refrigerant in the flow of refrigerant from the gas cooler/condenser 20 to move toward the target exit pressure 708. The ambient temperature around the system 10 when data for the graph 700 was collected was 60° F.

Figure 8:
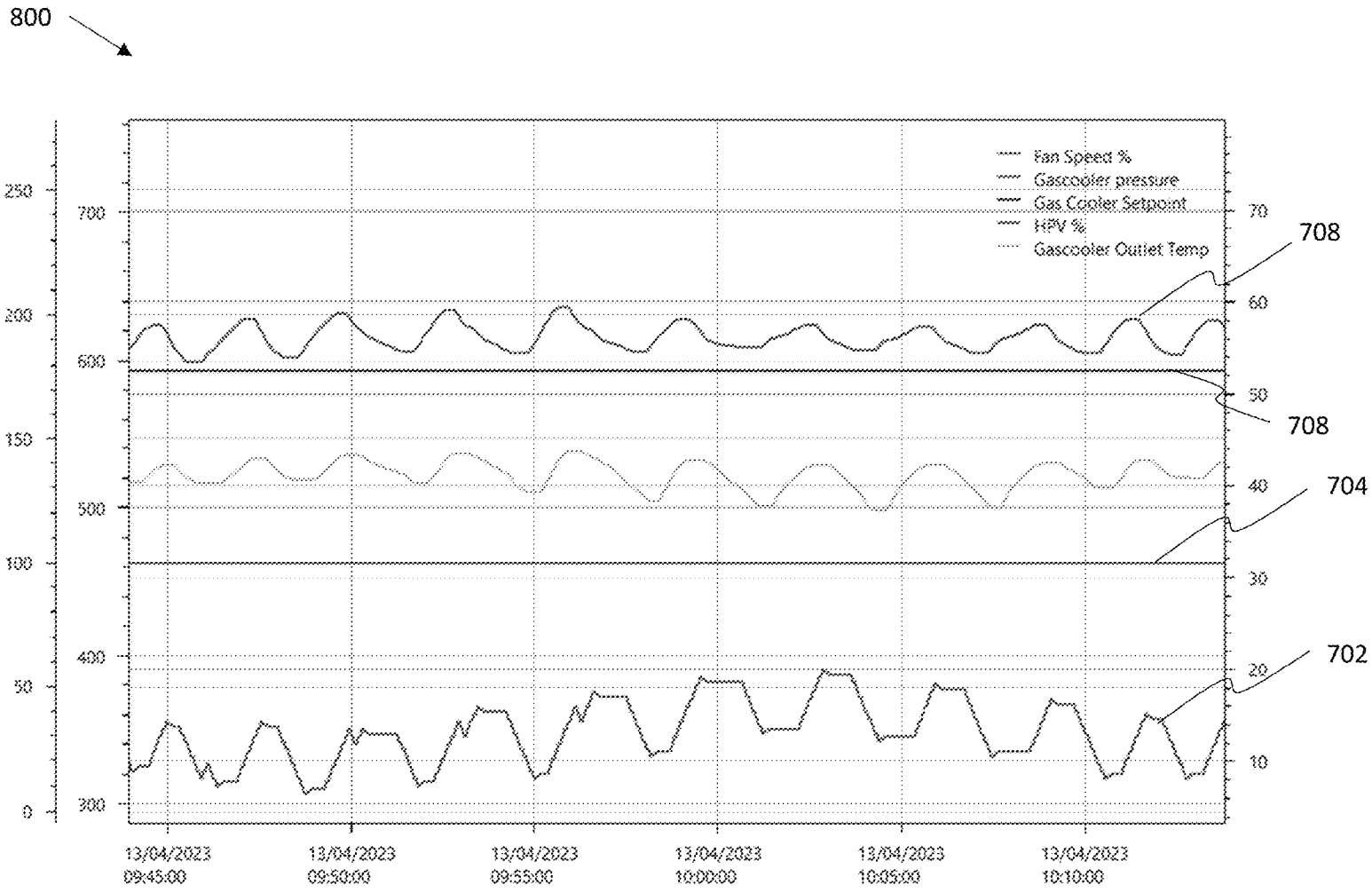
FIG. 8 is a graph of the fan speed percentage, the HPV open percentage, the exit pressure of the refrigerant in the flow of refrigerant from the gas cooler/condenser, and the target exit pressure for the system of FIG. 1 operated according to the algorithm of FIG. 6 at an ambient temperature of about 20° F.

If the inlet air temperature is less than a minimum condensing saturated temperature, a low ambient condition exists and the controller determines, at 608 if the pressure setpoint of the liquid receiver 21 is greater than the minimum condensing pressure from the compressor envelope. If the pressure setpoint of the liquid receiver 21 is not greater than the minimum condensing pressure, the controller 50 operates the system 10 according to its standard operation at 606. If the pressure setpoint of the liquid receiver 21 is greater than the minimum condensing pressure, the controller 50 opens the HPV 30 100% at 610, which allows the liquid receiver 21 to maintain an adequate liquid level to supply the evaporators for refrigeration and leaves the fan speed as the only variable needing to be controlled. The controller 50 then begins controlling the speed of the fan 27 (by using the speed control 29 to control the fan motor 28) to control the exit pressure of the refrigerant in the flow of refrigerant toward the target pressure. This operation is shown in the graph 800 in FIG. 8. In the graph 800, the HPV open percentage 704 is constant at 100%, and the fan speed percentage 702 is controlled to cause the exit pressure 706 of the refrigerant in the flow of refrigerant from the gas cooler/condenser 20 to move toward the target exit pressure 708. The ambient temperature around the system 10 when data for the graph 800 was collected was 20° F.

In another embodiment similar to the control algorithm 600, the fan speed percentage is controlled to attempt to cause the exit pressure of the refrigerant in the flow of refrigerant from the gas cooler/condenser to move toward a target exit pressure that is set slightly above the bottom of the compressor envelope (e.g., 40 bar and (580 psia) in an example system). Targeting gas cooler/condenser exit pressure slightly higher than the envelop bottom causes the fan to only regulate when the gas cooler/condenser pressure target for the HPV is set to the bottom of the compressor envelope, otherwise it will run 100%.

In this embodiment, when the gas cooler/condenser exit pressure is higher than the pressure at the bottom of the compressor envelope, the fan will operate at 100% speed because its target is set slightly above the pressure at the bottom of the compressor envelope and it can never be reached so long as the HPV is being controlled to regulate the gas cooler/condenser exit pressure to the pressure at the bottom of the compressor envelope target. These conditions typically exist when the ambient temperature is not a low ambient condition. In some embodiments, these conditions exist when the ambient temperature is about 41.5° F. or higher.

When the gas cooler/condenser exit pressure target is less than the fan target pressure (which is slightly above the pressure at the bottom of the compressor envelope), the HPV will be open to 100% and the fan speed percentage will vary as needed to attempt to cause the exit pressure of the refrigerant in the flow of refrigerant from the gas cooler/condenser to move toward its target exit pressure that is slightly above the bottom of the compressor envelope. In one example system, the bottom of the compressor envelope is 40 bar and the target gas cooler/condenser pressure for the fan is 41 bar.

Figure 9:
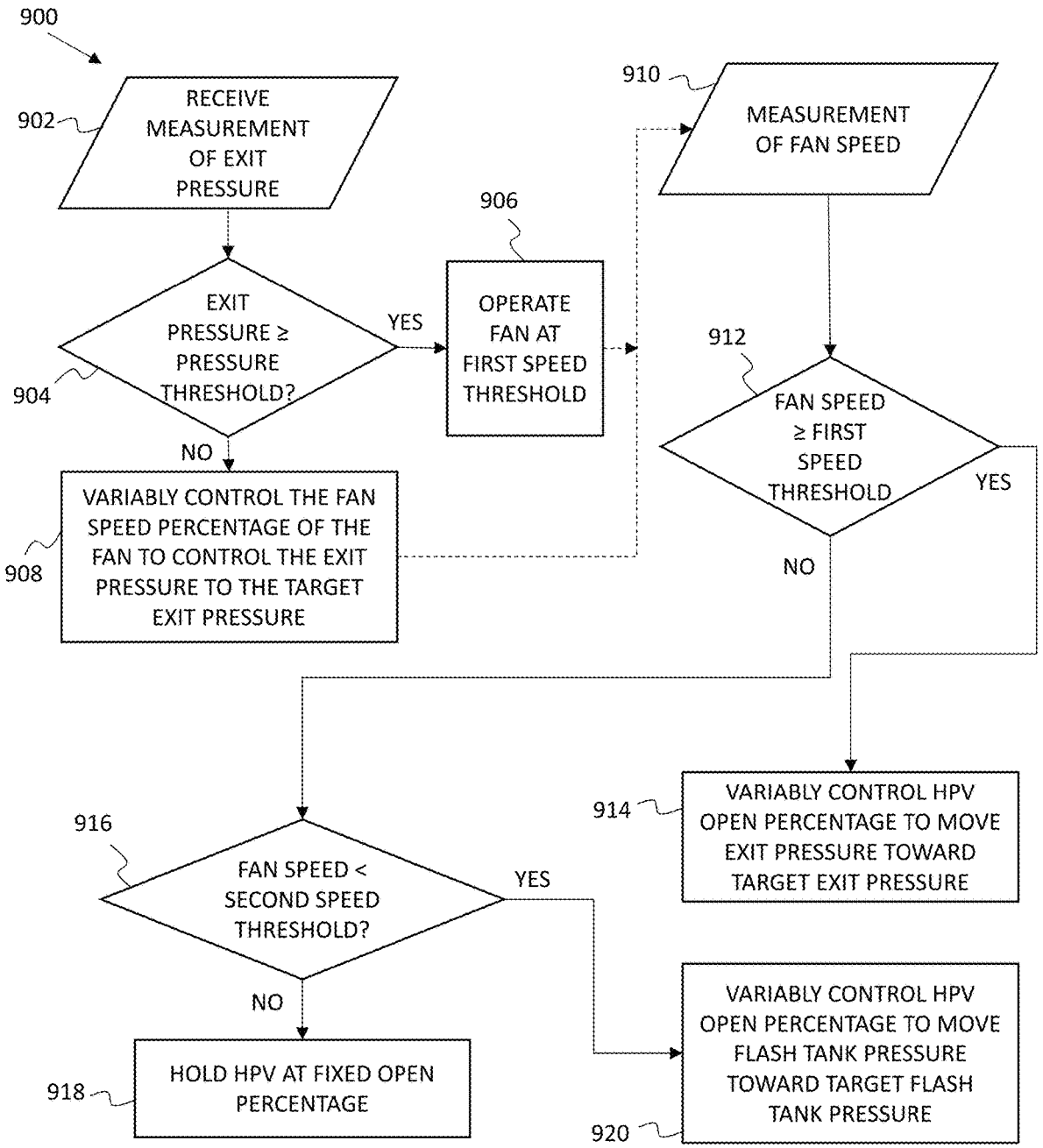
FIG. 9 is a flow diagram of an example control algorithm of the present disclosure for controlling the CO2 refrigeration system of FIG. 1.

FIG. 9 is a flow diagram of an example control algorithm 900 of the present disclosure for controlling a CO2 refrigeration system, such as the system 10 in FIG. 1. The control algorithm 900 will be described as being performed by system controller 50 in the example embodiment. In other embodiments, the control algorithm 900 may be performed by valve controller 60 and speed controller 29. The control algorithm 900 may be performed with one or more aspects of other control algorithms discussed above.

At 902, the controller 50 receives a measurement of the exit pressure exit pressure of refrigerant exiting the gas cooler/condenser 20, for example from refrigerant pressure sensor 64. The controller 50 determines from the measurement at 904 if the exit pressure exceeds or is equal to a pressure threshold. The pressure threshold is a pressure above a minimum exit pressure of refrigerant from the gas cooler/condenser 20. The minimum exit pressure may be the minimum pressure for the compressor (i.e. the bottom pressure of the compressor envelope for the compressor). In some embodiments, the pressure threshold is equal to the minimum exit pressure of the refrigerant from the gas cooler/condenser 20 plus a predetermined amount. Alternatively, the pressure threshold may be equal to the minimum exit pressure of the refrigerant from the gas cooler/condenser 20 plus a determined, calculated, or variable amount. The pressure threshold is a configurable (e.g., user selectable, selectable by the manufacturer/installer, or the like). In one example embodiment, the pressure threshold is about 650 PSIA.

If the exit pressure exceeds or is equal to the pressure threshold, at 906 the controller 50 operates the fan 27 at a fixed first speed threshold. The first speed threshold is a threshold indicating the fan 27 is running about full/100% speed. As used herein, full or 100% speed is the maximum fan speed used in operation, which is not always (but sometimes is) the maximum speed at which the fan is capable of operating. Thus, in some embodiments, the first speed threshold is 100% speed. In other embodiments, the first speed threshold is any other suitable speed near 100%, such as 101%, 99%, 98%, 97%, 96%, 95%, and the like. If the exit pressure is less than the pressure threshold, the controller 50 variably controls the speed of the fan 27 to control the exit pressure toward a target exit pressure at 908. The target exit pressure may be set by any suitable method, including those discussed above.

In the algorithm 900, control of the HPV 30 and the goal of the control of the HPV 30 are determined based on the speed of the fan 27. Speed thresholds are used to define two or three operating regions, an upper region and a lower region in embodiments with two regions and upper, lower, and transition regions in embodiments with three operating regions. In embodiments with three operating regions, the transition region acts as a transition (in both directions) between operation in the upper and lower regions. The example embodiment shown in FIG. 9 uses three regions. In operation, the different operating regions typically correspond to different relative ambient temperatures in which the system is operating. That is, the system is typically in the upper operating region when the ambient temperatures are the normal/warm temperatures for the particular system. The lower operating region occurs when the ambient temperature around the system is low for the particular system. The ambient temperature when operating in the lower operating region may be at or below about 41.5° F.

At 910, the controller obtains a measurement of the fan speed, such as from the speed controller 29, from a last commanded speed for the fan 27, from a speed sensor coupled to the fan 27, or the like. The controller determines at 912 if the fan speed is greater than or equal to the first speed threshold. If the controller 50 determines 912 that the fan speed is above or equal to the first speed threshold, it is in the upper operating region and the controller 50 variably controls the HPV 30 to control the exit pressure toward the target exit pressure at 914. It should be noted that this variable control 914 of the HPV 30 occurs while the fan 27 is operated 906 at the fixed first speed threshold.

If the controller 50 determines 912 that the fan speed is not above or equal to the first speed threshold, the controller 50 then determines at 916 if the fan speed is less than a second speed threshold. In the example embodiment, the second speed threshold is less than the first speed threshold, thus participating in definition of the transition region and the lower operating region. In one example, the second speed threshold is about 90% speed. In other examples, the second speed threshold is any other suitable speed, such as about 91%, 92%, 93%, 89%, 88%, or the like. If the controller 50 determines 916 that the fan speed is not less than the second speed threshold, it is in the transition region and the controller holds 918 the HPV 30 at a fixed open percentage. In the example, the fixed open percentage is 100% open. In other embodiments, the fixed open percentage is the current open percentage of the HPV 30 prior to making the determination at 916 or any other suitable fixed open percentage. Because the speed of the fan at this point is less than the first speed threshold, the controller 50 is holding 918 the HPV 30 at the fixed open position while variably controlling 908 the speed of the fan 27 to control the exit pressure toward a target exit pressure.

If the controller 50 determines 916 that the fan speed is less than the second speed threshold, it is in the lower operating region and the controller variably controls the HPV 30 (e.g., controls the open percentage of the HPV 30) to control a flash tank pressure of the liquid receiver/flash tank 21 toward a target flash tank pressure at 920. Because the speed of the fan at this point is less than the first speed threshold, the controller 50 is variably controlling the HPV to control the flash tank pressure toward the target flash tank pressure while variably controlling 908 the speed of the fan 27 to control the exit pressure toward the target exit pressure. In some embodiments, the control of the HPV 30 is slowed down when the controller 50 is variably controlling the HPV 30 to control the flash tank pressure toward the target flash tank pressure. For example, the size of the HPV adjustments that the controller would otherwise make may be reduced. In some embodiments, the adjustments are reduced by half. Alternatively, the adjustments may be reduced by 10%, 25%, 33%, 60%, or any other suitable reduction to slow down the HPV 30 opening/closing. In some embodiments, the target flash tank pressure is the flash tank setpoint (set by any suitable method) minus an adjustment amount. In some embodiments, the adjustment amount is about 0.5 bar, while other embodiments use any other suitable adjustment amount. By controlling the flash tank pressure to an amount below the setpoint, the controller 50 can, under certain operating conditions, cause the BGV 40 to close completely, which may improve system efficiency and stability.

Embodiments with only two operating regions do not include the transition region. Practically, such embodiments do not include the second speed threshold, but they may be visualized from FIG. 9 by considering the second speed threshold equal to the first speed threshold. Thus, if the controller determines that the fan speed is not greater than or equal to the first speed threshold at 912, the fan speed must be less than the second speed threshold (which is also the first speed threshold) and the algorithm proceeds directly to variably control the HPV open percentage to regulate the flash tank pressure at 920. Again, practically, the second speed threshold is simply not used in such embodiments and steps 916 and 918 in FIG. 9 are removed and step 920 is connected directly to a negative answer at step 912.

Figure 10:
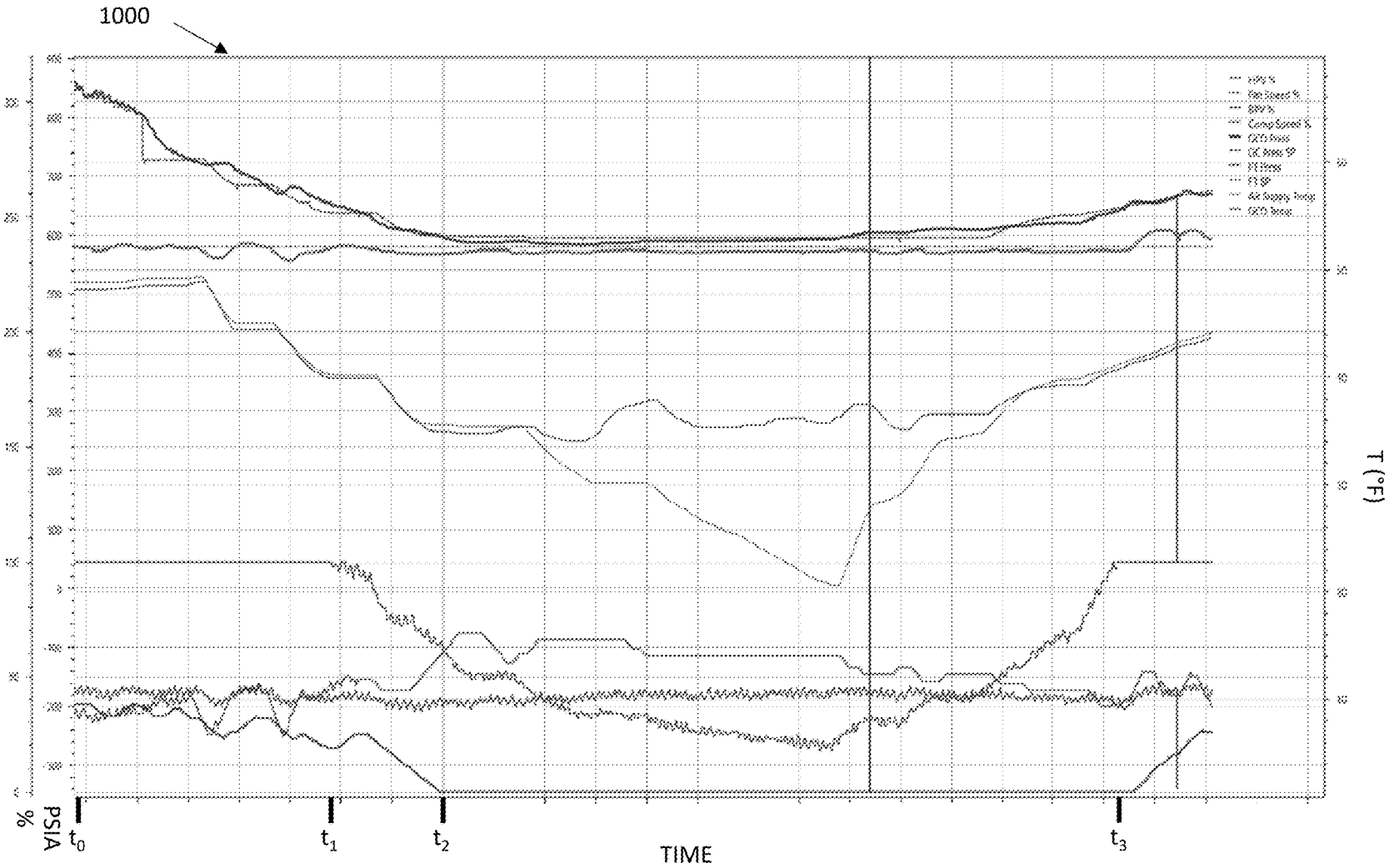
FIG. 10 is a graph of the various operating characteristics of an example system operating using a two region version of the algorithm of FIG. 9 over a period of time.

FIG. 10 is a graph 1000 of the various operating characteristics of an actual system operating using the two region version of the algorithm 900 over a period of time. As can be seen, the system begins operating in the upper operating region with the fan speed (Fan Speed %) being held at 100% speed from $t_0$ to $t_1$ and the ambient air temperature (Air Supply Temp) varying from about 50° down to about 41.5° F. During that time period, the HPV open percentage (HPV %) is controlled to drive the exit pressure (GCO Press) toward the target exit pressure (GC Press SP). At about time $t_1$, the exit pressure drops below the pressure threshold of about 650 PSIA and the fan speed is now variably controlled to drive the exit pressure toward the target exit pressure. After time $t_1$, the system is in the lower operating region. Because the fan speed has dropped from the first speed threshold (100% in this example), the controller 50 controls the HPV open percentage to control the flash tank pressure (FT Press) to a target pressure that is an amount (e.g., 0.5 bar) below the flash tank setpoint (FT SP). As can be seen, at about time $t_2$, the BGV 40 is completely closed and remains so until after time $t_3$ (discussed next). During the time from $t_1$ to $t_3$, the overall system remains stable and the speed of the compressor (Comp Speed %) is stable, while the ambient air temperature (Air Supply Temp) varies from about 41° down to almost 20° F. At about time $t_3$, the exit pressure has increased to the pressure threshold of about 650 PSIA. At this point, the system is back in the upper operation region. The fan speed is subsequently controlled to the fixed speed of 100% and the HPV open percentage is controlled to variably control the exit pressure to the target exit pressure.

Many known CO2 control systems utilize HPV to regulate the gas cooler/condenser exit pressure to an exit pressure setpoint. The pressure in the flash tank of such systems is typically regulated to a flash tank setpoint by the BGV. The operation of these control elements are typically independent of each other. In such systems, when the flash tank pressure rises above the setpoint, the BGV opens to relieve this pressure. When the BGV opens, mass flow for the evaporators is diverted to the suction line/inlet of the compressor(s). This reduces capacity and efficiency, causes the suction pressure to rise and the compressor to increase speed. Therefore, keeping the BGV closed or nearly closed is desirable for system capacity, efficiency, and stability.

Figure 11:
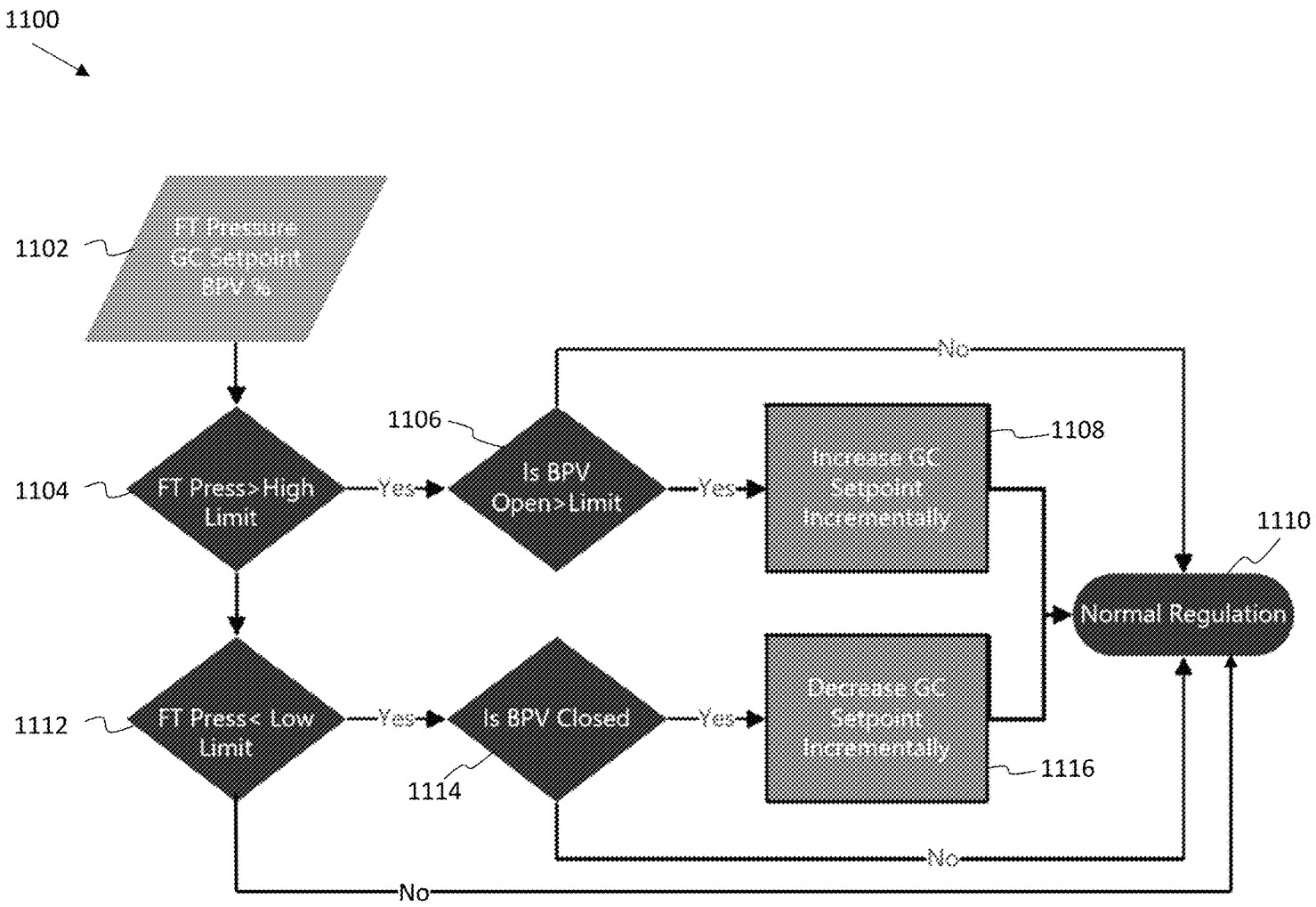
FIG. 11 is a flow diagram of an example control algorithm of the present disclosure for controlling the CO2 refrigeration system of FIG. 1 and keeping the BGV closed when possible.

FIG. 11 is a flow diagram of an example control algorithm 1100 of the present disclosure for controlling a CO2 refrigeration system, such as the system 10 in FIG. 1, and keeping the BGV 40 closed when possible. The control algorithm 1100 will be described as being performed by system controller 50 in the example embodiment. In other embodiments, the control algorithm 1100 may be performed by valve controller 60. The control algorithm 1100 may be performed with one or more aspects of other control algorithms discussed above.

Generally, the algorithm 1100 uses the pressure setpoint for the refrigerant exiting the gas cooler/condenser 20 to act as a variable in the control of the flash tank pressure. When appropriate and depending on operating conditions, the exit pressure setpoint for the gas cooler/condenser 20 is increased, which will result in a decrease in the flash tank pressure and possibly a decrease in the amount that the BGV 40 is open, or the exit pressure setpoint for the gas cooler/condenser 20 is decreased, which will result in an increase in the flash tank pressure and possibly an increase in the amount that the BGV 40 is open (if at all).

The algorithm 1100 is performed while the system is being otherwise controlled according to any other suitable control scheme(s), including those discussed herein, in which (or during a time that) the HPV 30 is being controlled to regulate the exit pressure of refrigerant exiting the gas cooler/condenser 20 to the target exit pressure (i.e., the exit pressure setpoint). At 1102 the controller 50 obtains the flash tank pressure, the exit pressure setpoint for refrigerant exiting the gas cooler/condenser 20, and the percentage that the BGV 40 is open. These values may be obtained from sensors, from previous commands, retrieved from memory, or by any suitable method for obtaining the values.

The controller 50 compares the flash tank pressure to a first limit at 1104. In the example embodiment, the first limit is a pre-alarm limit that is a pressure more than desired, but not at a level high enough to require an alarm. The first limit may be the target flash tank pressure (i.e., the flash tank setpoint), a flash tank pressure some amount above the target flash tank pressure, or may be any other suitable limit value.

If the flash tank pressure is greater than the first limit, at 1106 the controller 50 checks if the percentage that the BGV 40 is open more than a BGV limit. The BGV limit is a maximum amount that the BGV is desired to be open. In some embodiments, the BGV limit may be generally equal the BGV 40 being closed. That is, if the BGV 40 is open at all, its open percentage is greater than the limit in such embodiments. In other embodiments, the BGV limit is some amount greater than completely closed, such as 10% open, 20% open, 30% open, 40% open, or the like. If the percentage that the BGV 40 is not open more than the BGV limit, the algorithm proceeds to 1110 and normal regulation continues. If the percentage that the BGV 40 is open more than the BGV limit, the controller 50 increases the exit pressure setpoint of the cooler/condenser 20 at 1108. Generally, the increase will be a relatively small increase, such five PSIA, ten PSIA, fifteen PSIA, twenty PSIA, twenty-five PSIA, fifty PSIA, or the like. In some embodiments, the increase is less than one hundred PSIA. In some embodiments, the increase is less than five percent or less than ten percent of the current (not yet increased) exit pressure setpoint. While the HPV 30 is controlled to regulate the exit pressure of refrigerant exiting the gas cooler/condenser 20 to the exit pressure setpoint, an increase in the exit pressure setpoint will causes the HPV 30 to close more to increase the exit pressure. This change also has the effect of lowering the flash tank pressure. In some embodiments, the increase in the exit pressure setpoint is repeated until the flash tank pressure is equal to or below the first limit or the BGV 40 is open equal to or below the BGV limit, and then the algorithm returns to normal regulation of the system at 1110. That is, the algorithm 1100 may loop back from 1108 to 1102. In some embodiments, the increase in exit pressure setpoint occurs once at 1108 and the system returns to normal regulation of the system at 1110. In such embodiments, normal regulation may include periodically (e.g., once every second, once every minute, once every thirty minutes, once every hour, every time some control event occurs, once every control cycle, once every other control cycle, or the like) returning to 1102 and repeating the algorithm 1100.

If the flash tank pressure is not greater than the first limit, at 1112 the controller 50 checks if the flash tank pressure is less than a second limit. The second limit is less than the first limit. Thus, the first limit may be referred to as a high limit and the second limit may be referred to as a low limit. The second limit generally a minimum desired flash tank pressure. In some embodiments, the second limit is ninety percent of the flash tank pressure setpoint. In other embodiments, the second limit is ninety-five percent of the flash tank pressure setpoint, eighty-five percent of the flash tank pressure setpoint, is a fixed amount below the flash tank pressure setpoint (such as twenty-five PSIA below the setpoint, fifty PSIA below the setpoint, etc.), or is a fixed pressure. If the flash tank pressure is not less than the second limit, the algorithm returns to normal regulation at 1110. If the flash tank pressure is less than the second limit, the controller 50 determines if the BGV 40 is closed (i.e., if the percentage that the BGV 40 is open is substantially zero percent open) at 1114. If the BGV 40 is not closed, the algorithm proceeds to 1110 and normal regulation continues. If the BGV 40 is closed, the controller 50 decreases the exit pressure setpoint of the cooler/condenser 20 at 1116. As with the increase at 1108, the decrease will generally be a relatively small decrease, such five PSIA, ten PSIA, fifteen PSIA, twenty PSIA, twenty-five PSIA, fifty PSIA, or the like. In some embodiments, the decrease is less than one hundred PSIA. In some embodiments, the decrease is less than five percent or less than ten percent of the current (not yet decreased) exit pressure setpoint. The amount by which the exit pressure setpoint is decreased in 1116 may be the same amount or a different amount than that by which the exit pressure setpoint is increased in 1108. While the HPV 30 is controlled to regulate the exit pressure of refrigerant exiting the gas cooler/condenser 20 to the exit pressure setpoint, a decrease in the exit pressure setpoint will causes the HPV 30 to open more to decrease the exit pressure. This change also has the effect of increasing the flash tank pressure. In some embodiments, the decrease in the exit pressure setpoint is repeated until the flash tank pressure is equal to or above the second limit or the BGV 40 is open, and then the algorithm returns to normal regulation of the system at 1110. That is, the algorithm 1100 may loop back from 1116 to 1102. In some embodiments, the decrease in exit pressure setpoint occurs once at 1116 and the system returns to normal regulation of the system at 1110. In such embodiments, normal regulation may include periodically (e.g., once every second, once every minute, once every thirty minutes, once every hour, every time some control event occurs, once every control cycle, once every other control cycle, or the like) returning to 1102 and repeating the algorithm 1100.

Figure 12:
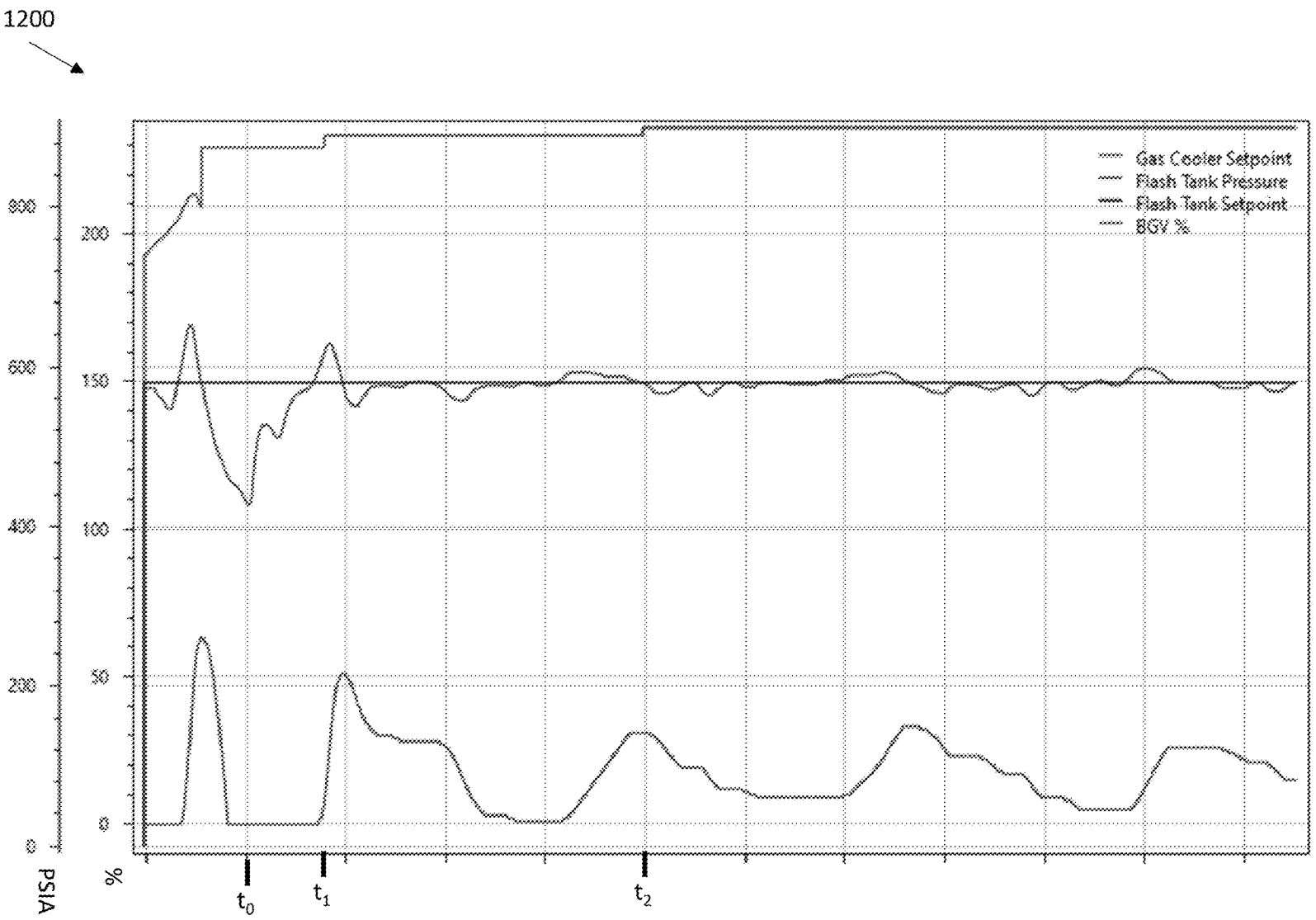
FIG. 12 is a graph of the various operating characteristics of the system of FIG. 1 operating using the control regulation that includes the algorithm of FIG. 11.

FIG. 12 is a graph 1200 of the various operating characteristics of an example system operating using the control regulation that includes the algorithm 1100. At time $t_0$, the system is operating with the flash tank pressure well below the flash tank setpoint and the BGV 40 is fully closed (i.e., BGV open percentage—BGV %—is 0). After time $t_0$, the flash tank pressure begins to rise. At time $t_1$, the flash tank pressure has climbed above the flash tank setpoint and the controller 50 has begun opening the BGV 40 to reduce the pressure. At this time, the flash tank pressure is greater than the first limit and the BGV 40 is open more than the BGV limit. Thus, the controller 50 increases the exit pressure setpoint for the gas cooler/condenser 20, which causes the flash tank pressure to decrease after $t_1$. As the flash tank pressure decreases, the controller 50 decreases the open percentage of the BGV 40 to regulate the flash tank pressure toward the flash tank setpoint. At time $t_2$, the flash tank pressure has again risen above the first limit and the BGV 40 is open more than the BGV limit. Thus, the controller 50 increases the exit pressure setpoint for the gas cooler/condenser 20, which causes the flash tank pressure to decrease after $t_2$. As the flash tank pressure decreases, the controller 50 again decreases the open percentage of the BGV 40 to regulate the flash tank pressure toward the flash tank setpoint.

Example embodiments of systems and methods for controlling a $CO_2$ refrigeration system are described above in detail. The system is not limited to the specific embodiments described herein, but rather, components of the system may be used independently and separately from other components described herein. For example, the controller and processor described herein may also be used in combination with other systems and methods and are not limited to practice with only the system as described herein.

This written description uses examples to disclose the invention, including the best mode, and also to enable any person skilled in the art to practice the invention, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A $CO_2$ refrigeration system comprising:

a compressor;

a gas cooler/condenser that receives refrigerant discharged from the compressor and outputs a flow of refrigerant, the gas cooler/condenser operable as a gas cooler when the $CO_2$ refrigeration system is operating in a transcritical mode and as a condenser when the $CO_2$ refrigeration system is operating in a subcritical mode;

a flash tank connected to receive refrigerant output from the gas cooler/condenser;

a bypass valve (BGV) between the flash tank and a suction side of the compressor to control a flow of refrigerant from the flash tank to the suction side of the compressor; and a controller having a processor and a memory, the processor configured by instructions stored in the memory to perform the steps of:

obtaining a target exit pressure of the refrigerant from the gas cooler/condenser, a measurement of a pressure of the flash tank, and an open percentage of the BGV;

determining, based at least in part on the pressure of the flash tank and the open percentage of the BGV, whether or not to decrease the pressure of the flash tank; and increasing the target exit pressure by an amount when the controller determines to decrease the pressure of the flash tank.

2. The $CO_2$ refrigeration system of claim 1, wherein the processor is configured to determine to decrease the pressure of the flash tank when the pressure of the flash tank exceeds a first limit and the open percentage of the BGV exceeds a BGV limit.

3. The $CO_2$ refrigeration system of claim 2, wherein the first limit comprises a flash tank pressure setpoint.

4. The $CO_2$ refrigeration system of claim 2, wherein the processor is configured to repeat the steps of obtaining, determining whether or not to decrease the pressure of the flash tank, and increasing the target exit pressure by the amount until the flash tank pressure does not exceed the first limit or the open percentage of the BGV does not exceed the BGV limit.

5. The $CO_2$ refrigeration system of claim 1, wherein the processor is configured by the instructions stored in the memory to perform the steps of:

determining, based at least in part on the pressure of the flash tank and the open percentage of the BGV, whether or not to increase the pressure of the flash tank; and decreasing the target exit pressure by the amount when the controller determines to increase the pressure of the flash tank.

6. The $CO_2$ refrigeration system of claim 5, wherein the processor is configured to determine to increase the pressure of the flash tank when the pressure of the flash tank is below a second limit lower than the first limit and the open percentage of the BGV indicates the BGV is closed.

7. The $CO_2$ refrigeration system of claim 6, wherein the processor is configured to repeat the steps of obtaining, determining whether or not to increase the pressure of the flash tank, and decreasing the target exit pressure by the amount until the flash tank pressure is not less than the second limit or the open percentage of the BGV does not indicate that the BGV is closed.

8. A controller for a $CO_2$ refrigeration system including a compressor, a gas cooler/condenser that receives refrigerant discharged from the compressor and outputs a flow of refrigerant, a flash tank connected to receive refrigerant output from the gas cooler/condenser, and a bypass valve (BGV) between the flash tank and a suction side of the compressor to control a flow of refrigerant from the flash tank to the suction side of the compressor, the controller comprising:

a processor; and a memory, the processor configured by instructions stored in the memory to perform the steps of:

obtaining a target exit pressure of the refrigerant from the gas cooler/condenser, a measurement of a pressure of the flash tank, and an open percentage of the BGV;

determining, based at least in part on the pressure of the flash tank and the open percentage of the BGV, whether or not to decrease the pressure of the flash tank; and increasing the target exit pressure by an amount when the controller determines to decrease the pressure of the flash tank.

9. The controller of claim 8, wherein the processor is configured by the instructions stored in the memory to determine to decrease the pressure of the flash tank when the pressure of the flash tank exceeds a first limit and the open percentage of the BGV exceeds a BGV limit.

10. The controller of claim 9, wherein the first limit comprises a flash tank pressure setpoint.

11. The controller of claim 9, wherein the processor is configured by the instructions stored in the memory to repeat the steps of obtaining, determining whether or not to decrease the pressure of the flash tank, and increasing the target exit pressure by the amount until the flash tank pressure does not exceed the first limit or the open percentage of the BGV does not exceed the BGV limit.

12. The controller of claim 8, wherein the processor is configured by the instructions stored in the memory to perform the steps of:

determining, based at least in part on the pressure of the flash tank and the open percentage of the BGV, whether or not to increase the pressure of the flash tank; and decreasing the target exit pressure by the amount when the controller determines to increase the pressure of the flash tank.

13. The controller of claim 12, wherein the processor is configured by the instructions stored in the memory to determine to increase the pressure of the flash tank when the pressure of the flash tank is below a second limit lower than the first limit and the open percentage of the BGV indicates the BGV is closed.

14. The controller system of claim 13, wherein the processor is configured by the instructions stored in the memory to repeat the steps of obtaining, determining whether or not to increase the pressure of the flash tank, and decreasing the target exit pressure by the amount until the flash tank pressure is not less than the second limit or the open percentage of the BGV does not indicate that the BGV is closed.

15. A method of controlling a $CO_2$ refrigeration system including a compressor, a gas cooler/condenser that receives refrigerant discharged from the compressor and outputs a flow of refrigerant, a flash tank connected to receive refrigerant output from the gas cooler/condenser, and a bypass valve (BGV) between the flash tank and a suction side of the compressor to control a flow of refrigerant from the flash tank to the suction side of the compressor, the method comprising:

obtaining a target exit pressure of the refrigerant from the gas cooler/condenser, a measurement of a pressure of the flash tank, and an open percentage of the BGV;

determining, based at least in part on the pressure of the flash tank and the open percentage of the BGV, whether or not to decrease the pressure of the flash tank; and increasing the target exit pressure by an amount in response to the controller determining to decrease the pressure of the flash tank.

16. The method of claim 15, wherein determining whether or not to decrease the pressure of the flash tank comprises determining to decrease the pressure of the flash tank when the pressure of the flash tank exceeds a first limit and the open percentage of the BGV exceeds a BGV limit.

17. The method of claim 16, further comprising repeating the steps of obtaining, determining whether or not to decrease the pressure of the flash tank, and increasing the target exit pressure by the amount until the flash tank pressure does not exceed the first limit or the open percentage of the BGV does not exceed the BGV limit.

18. The method of claim 15, further comprising:

determining, based at least in part on the pressure of the flash tank and the open percentage of the BGV, whether or not to increase the pressure of the flash tank; and decreasing the target exit pressure by the amount when the controller determines to increase the pressure of the flash tank.

19. The method of claim 18, wherein determining whether or not to increase the pressure of the flash tank comprises determining to increase the pressure of the flash tank when the pressure of the flash tank is below a second limit lower than the first limit and the open percentage of the BGV indicates the BGV is closed.

20. The method of claim 19, further comprising repeating the steps of obtaining, determining whether or not to increase the pressure of the flash tank, and decreasing the target exit pressure by the amount until the flash tank pressure is not less than the second limit or the open percentage of the BGV does not indicate that the BGV is closed.

* * * * *